US010214988B2

(12) United States Patent
Sabins et al.

(10) Patent No.: US 10,214,988 B2
(45) Date of Patent: Feb. 26, 2019

(54) RISERLESS ABANDONMENT OPERATION USING SEALANT AND CEMENT

(71) Applicant: CSI Technologies LLC, Houston, TX (US)

(72) Inventors: Fred Sabins, Montgomery, TX (US); David Brown, Cypress, TX (US); Jeffrey Watters, Spring, TX (US); Jorge Esteban Leal, Houston, TX (US); Larry Watters, Spring, TX (US); Xiaoxu Li, The Woodlands, TX (US)

(73) Assignee: CSI TECHNOLOGIES LLC, Houston, TX (US)

( * ) Notice: Subject to any disclaimer, the term of this patent is extended or adjusted under 35 U.S.C. 154(b) by 50 days.

(21) Appl. No.: 15/185,357

(22) Filed: Jun. 17, 2016

(65) Prior Publication Data

US 2017/0044865 A1 Feb. 16, 2017

Related U.S. Application Data

(60) Provisional application No. 62/204,127, filed on Aug. 12, 2015.

(51) Int. Cl.
*E21B 33/14* (2006.01)
*E21B 33/13* (2006.01)
(Continued)

(52) U.S. Cl.
CPC ..... *E21B 33/14* (2013.01); *E21B 33/035* (2013.01); *E21B 33/12* (2013.01); *E21B 33/13* (2013.01); *E21B 33/134* (2013.01); *E21B 43/116* (2013.01)

(58) Field of Classification Search
None
See application file for complete search history.

(56) References Cited

U.S. PATENT DOCUMENTS 2,495,352 A 1/1950 Smith
3,308,884 A 3/1967 Robichaux
(Continued)

FOREIGN PATENT DOCUMENTS

EP 2363573 A1 9/2011
GB 2407835 A 5/2005
(Continued)

OTHER PUBLICATIONS

Hyne, Norman J.—Dictionary of Petroleum Exploration, Drilling, & Production, Jan. 1, 1991, PennWell Books, Tulsa, Oklahoma, XP055319754, ISBN: 978-0-87814-352-8, pp. 483-484.
(Continued)

*Primary Examiner* — Anuradha Ahuja
(74) *Attorney, Agent, or Firm* — Patterson + Sheridan, LLP

(57) ABSTRACT

A method for abandonment of a subsea well includes: setting a packer of a lower cementing tool against a bore of an inner casing hung from a subsea wellhead; fastening a pressure control assembly (PCA) to the subsea wellhead; hanging an upper cementing tool from the PCA and stabbing the upper cementing tool into a polished bore receptacle of the lower cementing tool; perforating a wall of the inner casing below the packer; perforating the inner casing wall above the packer by operating a perforator of the upper cementing tool; mixing a resin and a hardener to form a sealant; and pumping a fluid train through bores of the cementing tools and into an inner annulus formed between the inner casing and an outer casing hung from the subsea wellhead. The fluid train includes the sealant followed by a cement slurry.

17 Claims, 32 Drawing Sheets

(51) Int. Cl.

| | |
|---|---|
| ***E21B 33/035*** | (2006.01) |
| ***E21B 33/12*** | (2006.01) |
| ***E21B 33/134*** | (2006.01) |
| ***E21B 43/116*** | (2006.01) |

(56) References Cited

U.S. PATENT DOCUMENTS

| | | | | |
|---|---|---|---|---|
| 3,416,604 | A | 12/1968 | Rensvold | |
| 4,189,002 | A | 2/1980 | Martin | |
| 4,526,232 | A * | 7/1985 | Hughson | E02L 317/00 166/277 |
| 5,295,541 | A | 3/1994 | Ng et al. | |
| 5,314,023 | A | 5/1994 | Dartez et al. | |
| 5,377,757 | A | 1/1995 | Ng | |
| 5,484,020 | A | 1/1996 | Cowan | |
| 5,503,227 | A | 4/1996 | Saponja et al. | |
| 5,531,272 | A | 7/1996 | Ng et al. | |
| 5,875,845 | A | 3/1999 | Chatterji et al. | |
| 6,006,836 | A | 12/1999 | Chatterji et al. | |
| 6,478,088 | B1 | 11/2002 | Hansen et al. | |
| 7,219,732 | B2 | 5/2007 | Reddy | |
| 8,235,116 | B1 | 8/2012 | Burts, Jr. et al. | |
| 8,240,387 | B2 | 8/2012 | Hoffman et al. | |
| 2005/0241855 | A1 | 11/2005 | Wylie et al. | |
| 2005/0263282 | A1 | 12/2005 | Jeffrey et al. | |
| 2005/0269080 | A1 | 12/2005 | Cowan | |
| 2007/0163783 | A1 | 7/2007 | Head | |
| 2007/0209797 | A1 | 9/2007 | Brink et al. | |
| 2008/0023205 | A1 | 1/2008 | Craster et al. | |
| 2008/0135251 | A1 | 6/2008 | Nguyen et al. | |
| 2008/0264637 | A1 | 10/2008 | Burts et al. | |
| 2008/0277117 | A1 | 11/2008 | Burts, Jr. et al. | |
| 2009/0078419 | A1 | 3/2009 | Dusterhoft | |
| 2009/0253594 | A1 * | 10/2009 | Dalrymple | C09K 8/512 507/222 |
| 2009/0301720 | A1 | 12/2009 | Edwards et al. | |
| 2010/0051266 | A1 | 3/2010 | Roddy et al. | |
| 2010/0116504 | A1 | 5/2010 | Hoffman et al. | |
| 2010/0122650 | A1 | 5/2010 | Hoffman et al. | |
| 2011/0088916 | A1 | 4/2011 | Heijnen | |
| 2011/0192594 | A1 | 8/2011 | Roddy et al. | |
| 2011/0203795 | A1 * | 8/2011 | Murphy | C09K 8/42 166/292 |
| 2011/0277996 | A1 | 11/2011 | Cullick et al. | |
| 2011/0290501 | A1 | 12/2011 | Duncan et al. | |
| 2013/0118752 | A1 | 5/2013 | Hannegan et al. | |
| 2013/0269948 | A1 * | 10/2013 | Hoffman | E21B 33/035 166/351 |
| 2013/0284445 | A1 | 10/2013 | Hughes | |
| 2013/0319671 | A1 | 12/2013 | Lund et al. | |
| 2014/0076563 | A1 * | 3/2014 | Lin | E21B 33/13 166/295 |
| 2014/0213490 | A1 | 7/2014 | Ogle et al. | |
| 2014/0251612 | A1 | 9/2014 | Powers | |
| 2014/0262269 | A1 | 9/2014 | Watters et al. | |
| 2014/0357535 | A1 | 12/2014 | Tang et al. | |
| 2016/0108305 | A1 | 4/2016 | Murphy et al. | |
| 2016/0348464 | A1 | 12/2016 | Sabins et al. | |
| 2017/0044864 | A1 | 2/2017 | Sabins et al. | |

FOREIGN PATENT DOCUMENTS

| | | | |
|---|---|---|---|
| WO | 01/90531 | A1 | 11/2001 |
| WO | 2012057631 | A1 | 5/2012 |
| WO | 2014200889 | A1 | 12/2014 |
| WO | 2015034473 | A1 | 3/2015 |
| WO | 2015034474 | A1 | 3/2015 |
| WO | 2016024990 | A1 | 2/2016 |

OTHER PUBLICATIONS

EPO Search Report dated Jan. 25, 2017, for European Patent Application No. 16177357.7.

Canadian Office Action dated Mar. 8, 2017, for Canadian Patent Application No. 2,934,364.

EPO Partial European Search Report dated Sep. 26, 2016, for European Patent Application No. 18177357.7.

EPO Office Action dated Sep. 12, 2017, for European Application No. 16177357.7.

EPO Office Action dated Jan. 24, 2018, for European Application No. 16177362.7.

* cited by examiner

1

21
25
69
112
70
10

21
29
116
115b
114b
112
70
10

21
29
116
118
119
39
112
70
10

21
29
116
115c
114c
112
70
10

21
29
116
118
119
39
112
70
10

RISERLESS ABANDONMENT OPERATION USING SEALANT AND CEMENT

BACKGROUND OF THE DISCLOSURE

Field of the Disclosure

The present disclosure generally relates to a riserless well abandonment operation using sealant and cement.

Description of the Related Art

FIGS. 1A-1C illustrate a prior art completed subsea well. A portion of a conductor string 3 is driven into a floor 1*f* of the sea 1. The conductor string 3 includes a housing 3*h* generally extending above the seafloor and joints of conductor pipe 3*p* connected together, such as by threaded connections, extending into the sea floor. Once the conductor string 3 has been set, i.e., the joints of conductor pipe 3*p* driven into the sea floor 1*f*, a subsea wellbore 2 is drilled into the seafloor 1*f* through the conductor pipe 3 and extended into one or more subsurface formations 9*u*. A surface casing string 4 is deployed into the conductor string 3. The surface casing string 4 commonly includes a wellhead housing 4*h* supported on the housing 3*h* and joints of casing 4*c* connected together, using, for example, threaded connections, and extending inwardly of the conductor pipe 3*p*. The wellhead housing 4*h* lands in the conductor housing 3*h* during deployment of the surface casing string 4. Cement 8*s* is used to secure the surface casing string 4 in the wellbore 2 within the conductor pipe 3*p*. Once the surface casing string 2 is set, the wellbore 2 is further extended (drilled into) and an intermediate casing string 5 is then deployed into the wellbore. The intermediate casing string 5 commonly includes a hanger 5*h* and joints of casing 5*c* connected together, using, for example, threaded connections. Cement 8*i* is used to secure the intermediate casing string 5 in the wellbore 2 and seal of the space between the intermediate casing string 5 and the adjacent surface of the drilled borehole. The hanger 5*h* of the intermediate casing string 5 is supported in the wellhead housing 4*h*.

Once the intermediate casing string 5 has been set, the wellbore 2 is extended into (drilled into) a hydrocarbon-bearing (i.e., crude oil and/or natural gas) reservoir 9*r*. The production casing string 6 is then deployed into the wellbore. The production casing string 6 includes a hanger 6*h* supported on the hanger 5*h* of the intermediate casing string, and joints of casing 6*c* connected together, using, for example, threaded connections, extending therefrom through the intermediate casing string 5. Cement 8*p* is used to secure the production casing string 6 in the wellbore 2 and seal of the annular region between the production casing string 6 and the wall of the wellbore 2, at a location lower in the well than that of cement 8*i*. Each casing hanger 5*h*, 6*h* is sealed off in the wellhead housing 4*h* by a packoff. The housings 3*h*, 4*h* and hangers 5*h*, 6*h* are collectively referred to as a wellhead 10.

A production tree 15 is connected to the wellhead 10, such as by a tree connector 13. The tree connector 13 includes a fastening device, such as dogs, for fastening the tree to an external profile of the wellhead 10. The tree connector 13 further includes a hydraulic actuator and an interface, such as a hot stab, so that a remotely operated subsea vehicle (ROV) 20 (FIG. 2A) can operate the actuator for engaging the dogs with the external profile. The tree 15 is vertical or horizontal. If the tree is vertical (not shown), it is installed after a production tubing string 7 is hung from the wellhead 10. If the tree 15 is horizontal (as shown), the tree is installed and then the production tubing string 7 is hung from the tree 15. The tree 15 includes fittings and valves to control production from the wellbore 2 into a pipeline (not shown) which may lead to a production facility (not shown), such as a production vessel or platform.

The production tubing string 7 includes a hanger 7*h* and joints of production tubing 7*t* connected together, such as by threaded connections. The production tubing string 7 includes a subsurface safety valve (SSV) 7*v* interconnected with the tubing joints 7*t* and a hydraulic conduit 7*c* extending from the valve 7*v* to the hanger 7*h* as shown in FIG. 1B. The production tubing string 7 further includes a production packer 7*p* and the packer is set between the lower end of the production tubing string 7 and the production casing string 6 directly adjacent to the lower end of the production tubing to isolate an annulus 7*a* (aka the A annulus) formed therebetween from production fluid (not shown). The tree 15 is also in fluid communication with the hydraulic conduit 7*c*. A portion of the production casing string 6 is perforated by perforations 11 as shown in FIG. 1C, which are formed using a perforation tool to provide fluid communication between the reservoir 9*r* and a bore of the production tubing string 7. The production tubing string 7 is configured to transport production fluid from the reservoir 9*r* to the production tree 15.

The tree 15 includes a head 12, the tubing hanger 7*h*, the tree connector 13, an internal cap 14, an external cap 16, an upper crown plug 17*u*, a lower crown plug 17*b*, a production valve 18*p*, one or more annulus valves 18*u,b*, and a face seal 19. The tree head 12, tubing hanger 7*h*, and internal cap 14 each have a longitudinal bore extending therethrough. The tubing hanger 7*h* and head 12 each have a lateral production passage formed through walls thereof for the flow of production fluid therethrough. The tubing hanger 7*h* is disposed in the head 12 bore. The tubing hanger 7*h* is fastened to the head 12 by a latch.

Once the reservoir 9*r* is produced to depletion or is not feasible to produce or continue producing therefrom, the well may be abandoned. Conventionally, an abandonment operation includes cutting into the casings, and filling the annuli between the casing strings and the wellbore 2 wall with cement to seal the upper regions of the annuli. To achieve this, it is usual to use a semi-submersible drilling vessel (SSDV) which is located above the well and anchored in position. After removal of the cap 16 from the well, a unit including blow-out preventers and a riser is lowered and locked on to the wellhead. A tool string is run-in on pipe to sever or perforate the casing or casings. Weighted fluid is pumped into the well to provide a hydrostatic head to balance any possible pressure release when the casing is cut. The casing is then cut, and the annulus cemented. The cemented annulus is then pressure tested to ensure that an adequate seal between the casings and the wellbore 2 wall has been obtained. The casing is severed below the mud line and the casing hangers retrieved, and finally after removal all removable equipment is removed from the well, the well is filled with cement. Whilst by this procedure satisfactory well abandonment can be achieved, it is expensive in terms of the equipment involved and the time taken which is often from seven to ten days per well.

Historically, Portland cement has served as the standard for sealing the casing annulus for abandonment. However, Portland cement properties, both unset and set, are not ideal for creating a durable seal. The Portland cement slurry is aqueous and will dilute when intermixed with water present in the well. The set Portland cement is brittle and could fail over time. Therefore, a more durable sealant and seal are desired.

SUMMARY OF THE DISCLOSURE

The present disclosure generally relates to a riserless abandonment operation using sealant and cement. In one embodiment, a method for abandonment of a subsea well includes: setting a packer of a lower cementing tool in the bore of an inner casing hung from a subsea wellhead to form an obstructing seal therein; fastening a pressure control assembly (PCA) to the subsea wellhead; hanging an upper cementing tool from the PCA and stabbing the upper cementing tool into a polished bore receptacle of the lower cementing tool; perforating a wall of the inner casing below the packer; perforating the inner casing wall above the packer by operating a perforator of the upper cementing tool; mixing a resin and a hardener to form a sealant; and pumping a fluid train through bores of the cementing tools and into an inner annulus formed between the inner casing and an outer casing hung from the subsea wellhead. The fluid train includes the sealant followed by a cement slurry.

BRIEF DESCRIPTION OF THE DRAWINGS

So that the manner in which the above recited features of the present disclosure can be understood in detail, a more particular description of the disclosure, briefly summarized above, is had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 6A-7E illustrate sealing of an annulus formed between the production casing and the intermediate casing strings. FIG. 6A illustrates deployment of a lower perforating gun of the annulus cementing system.

FIG. 7D illustrates pumping cement slurry and the sealant into the annulus. FIG. 7E illustrates a cured sheath of cement and sealant in the annulus.

FIG. 8A illustrates deployment of a second lower perforating gun of the annulus cementing system. FIG. 8B illustrates firing of the second lower perforating gun to perforate the production and intermediate casing strings. FIG. 8C illustrates redeployment of the bore plug. FIG. 8D illustrates again setting the bore plug in the lower annulus cementing tool. FIG. 8E illustrates opening a second isolation sleeve of the upper annulus cementing tool. FIG. 8F illustrates firing of a second perforating gun of the upper annulus cementing tool to again perforate the production and intermediate casing strings. FIG. 8G illustrates repeat retrieval of the bore plug from the lower annulus cementing tool. FIG. 8H illustrates pumping the cement slurry and the sealant into the annulus. FIG. 8I illustrates a cured sheath of cement and sealant in the annulus and again setting the bore plug in the lower annulus cementing tool.

FIG. 9A illustrates deployment of an upper bridge plug. FIG. 9B illustrates setting the upper bride plug in the production casing. FIG. 9C illustrates cement plugging a bore of the production casing.

DETAILED DESCRIPTION

Figure 1A:
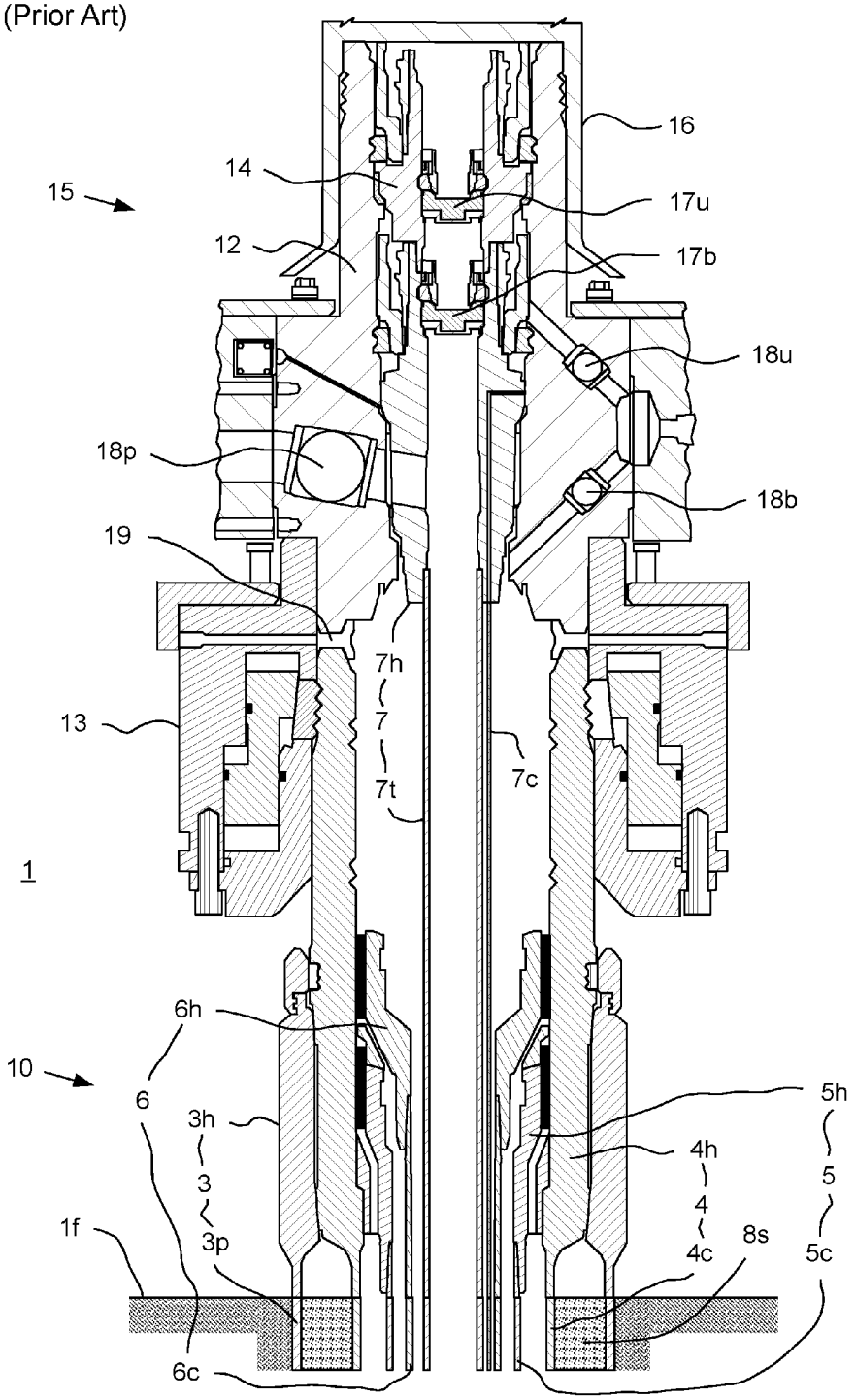
FIG. 1A (Prior Art)
FIGS. 1A-1C illustrate a prior art completed subsea well.
Figure 1B:
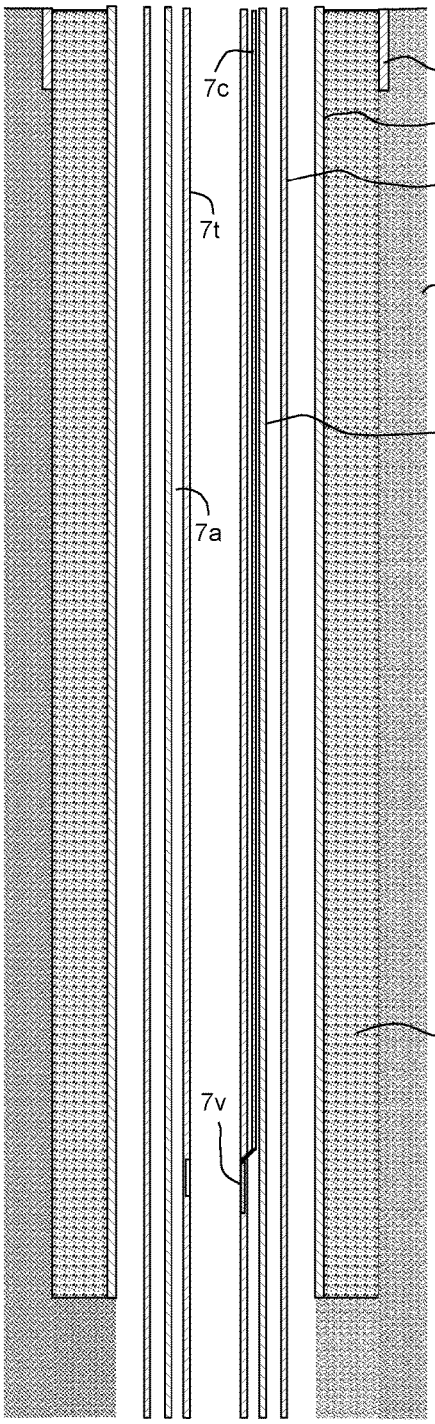
FIG. 1B (Prior Art)
Figure 1C:
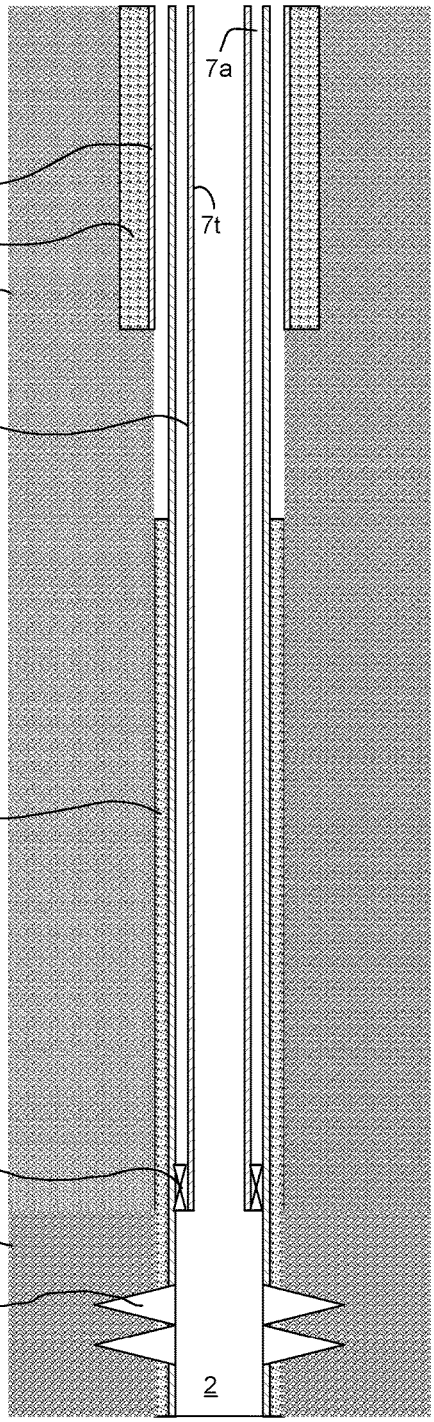
FIG. 1C (Prior Art)
Figure 2A:
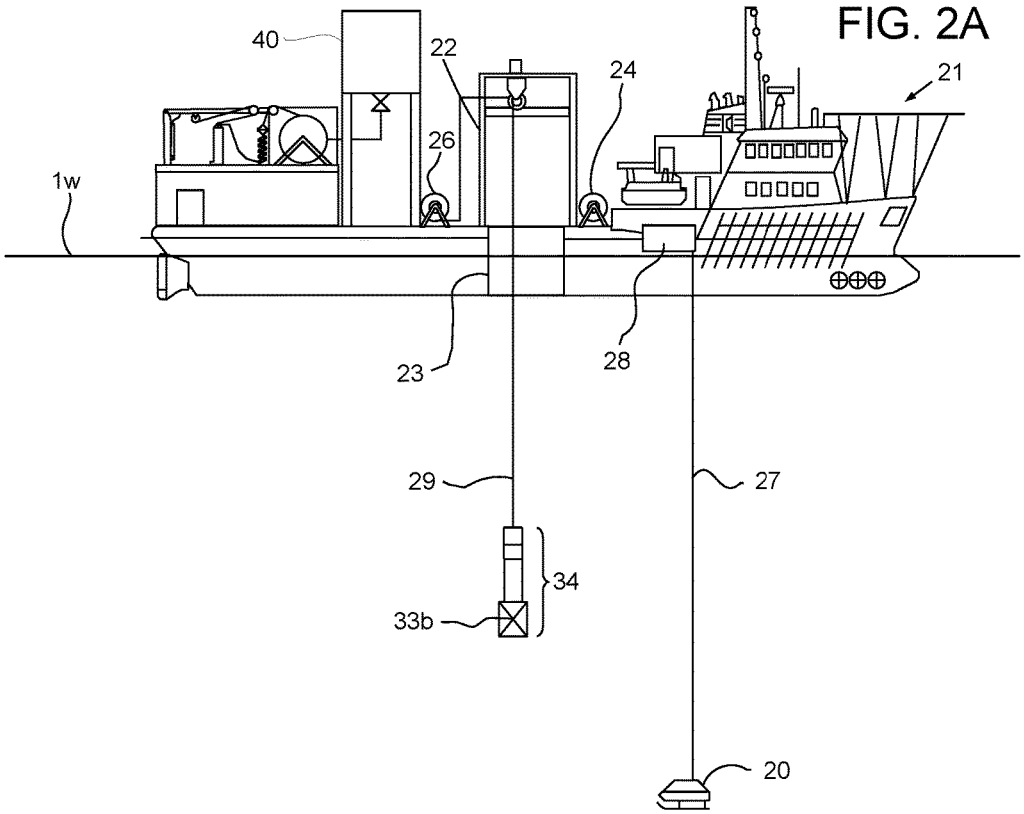
FIGS. 2A-2C illustrate deployment of a lower bridge plug to commence abandonment of an upper portion of the well after abandonment of a lower portion of the well, according to one embodiment of the present disclosure.
Figure 2A:
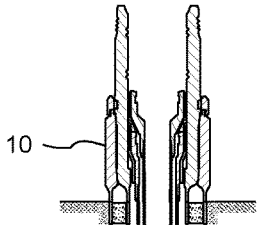
Figures 2B, 2C:
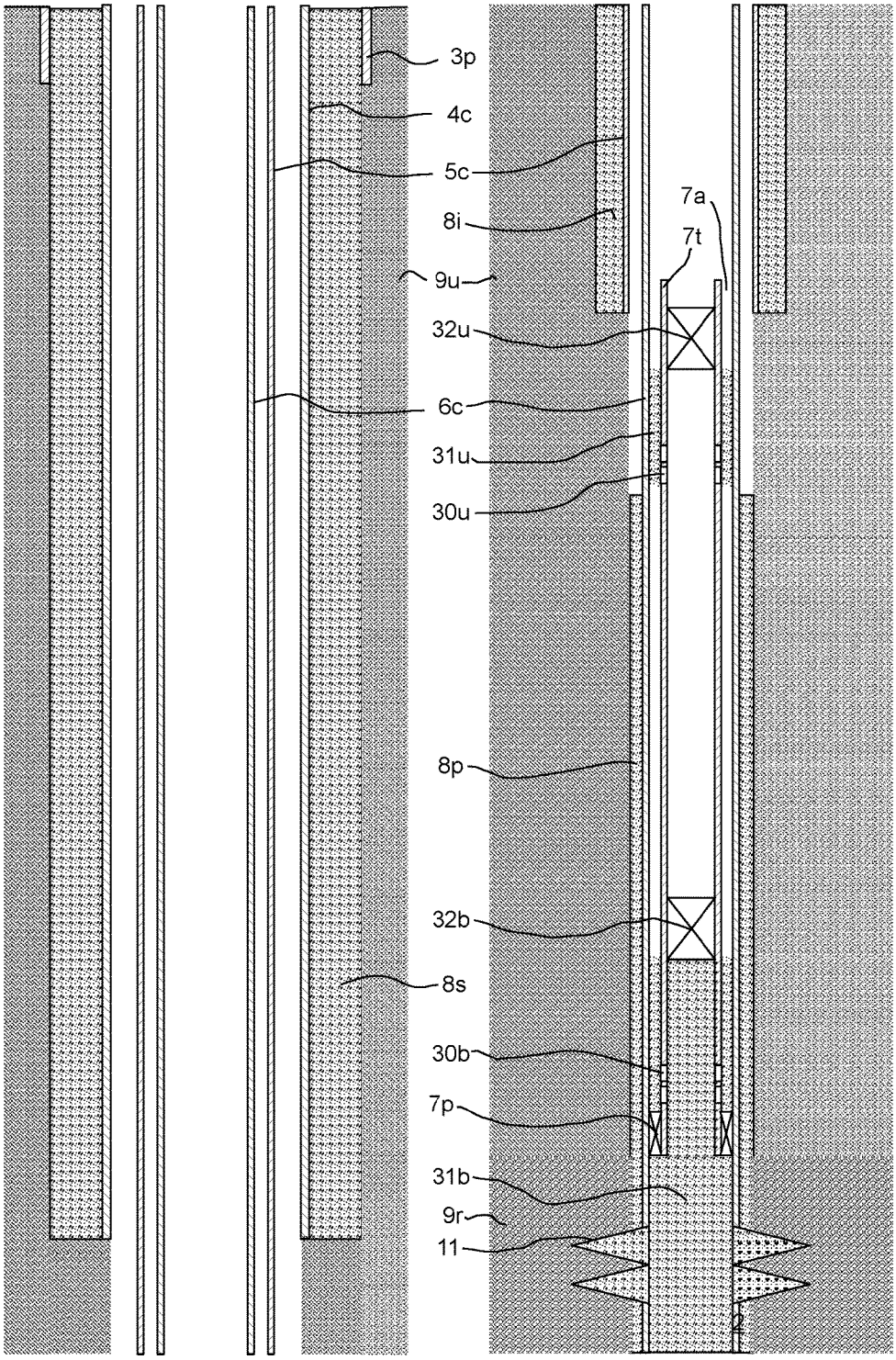
Figure 2D:
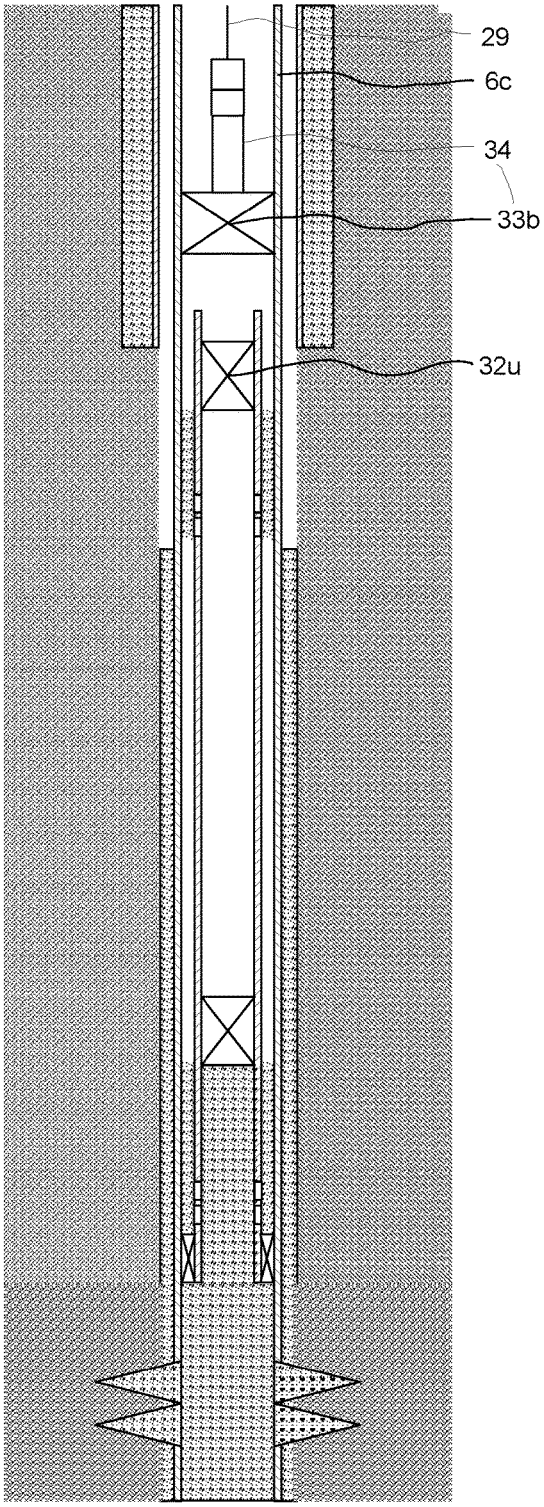
FIG. 2D illustrates setting the lower bride plug in the production casing string of the well.

FIGS. 2A-2C illustrate deployment of a lower bridge plug 33*b* to commence abandonment of an upper portion of the well after abandonment of a lower portion of the well, according to one embodiment of the present disclosure. FIG. 2D illustrates the setting position and setting of the lower bride plug 33*b* in the production casing string 6 of the well above the production tubing string 7.

To abandon the lower portion of the well, a support vessel 21 is deployed to the location of the subsea tree 15. The support vessel 21 is, in the embodiment, a light or medium intervention vessel and includes a dynamic positioning system to maintain position of the vessel 21 on the waterline 1*w* over the tree 15 and a heave compensator (not shown) to account for vessel heave due to wave action of the sea 1. The vessel 21 further includes a tower 22 located over a moonpool 23, and a winch 24. The winch 24 typically includes a drum having wire rope 25 (FIG. 4B) wrapped therearound and a motor for winding and unwinding the wire rope, thereby raising and lowering a distal end of the wire rope relative to the tower 22. The vessel 21 further includes a wireline winch 26 and a mixing unit 40.

An ROV 20 is deployed into the sea 1 from the vessel 21. The ROV 20 is an unmanned, self-propelled submarine that includes a video camera, an articulating arm, a thruster, and other instruments for performing a variety of tasks. The ROV 20 further includes a chassis made from a light metal or alloy, such as aluminum, and a float made from a buoyant material, such as syntactic foam, located at a top of the chassis. The ROV 20 is connected to support vessel 21 by an umbilical 27. The umbilical 27 provides electrical (power), hydraulic, and data communication between the ROV 20 and the support vessel 21. An operator on the support vessel 21 controls the movement and operations of ROV 20. The ROV umbilical 27 is wound or unwound from drum 28.

The ROV 20 is deployed to a location adjacent to the tree 15. The ROV 20 transmits video to the ROV operator for inspection of the tree 15. The ROV 20 removes the external cap 16 from the tree 15 and carries the cap to the vessel 21. The ROV 20 is then used to inspect the internal profile and components of the tree 15. The wire rope 25 is then be used to lower a pressure control head (not shown) through the moonpool 23 of the vessel 21 to the tree 15. The ROV 20 is used to guide the landing of the pressure control head onto the tree 15.

A seal head (not shown) is then deployed through the moonpool 23 using the wireline winch 26, and landed on the pressure control head. A plug retrieval tool (PRT) (not shown) is released from the seal head and electrical power is supplied to the PRT via wireline 29, thereby operating the PRT to remove the crown plugs 17*u,b*. A tree saver (not shown) may or may not then be installed in the production tree 15 using a modified PRT. Once the crown plugs 17*u,b* have been removed from the tree 15, a bottomhole assembly (BHA) (not shown) is connected to the wireline 29 and the seal head deployed to the pressure control head. The BHA includes a cablehead, a collar locator, and a perforating tool, such as a perforating gun.

Once the seal head has landed on the pressure control head, the SSV 7*v* (shown in FIG. 7*b*) is opened and the BHA is lowered into the wellbore 2 using the wireline 29. The BHA is deployed to a depth adjacent to and above the production packer 7*p*. Once the BHA has been deployed to its setting depth, electrical power is then be supplied to the BHA via the wireline 29 to fire the perforating gun into the production tubing 7*t*, thereby forming lower perforations 30*b* (FIG. 2C) through a wall thereof. The BHA is then retrieved to the seal head, and the seal head and BHA are dispatched from the pressure control head to the vessel 21. The lower annulus valve 18*b* on the tree 15 is then opened.

Cement slurry (not shown) is then pumped from the vessel 21, through the pressure control head, down the production tree 15 and production tubing 7*t*, and into the tubing annulus 7*a* after passing through the lower perforations 30*b* (FIG. 2C). Wellbore fluid displaced by the cement slurry flows up the tubing annulus 7*a*, through the wellhead 10, through the tree annulus port, and to the vessel 21. Once a desired quantity of cement slurry has been pumped into the tubing annulus 7*a*, the lower annulus valve 18*b* is closed while continuing to pump the cement slurry, thereby squeezing cement slurry into the reservoir 9*r*. Once pumped, the cement slurry is allowed to cure for a predetermined amount of time, such as one hour, six hours, twelve hours, or one day, thereby forming a lower cement plug 31*b*.

Once the lower cement plug 31*b* has cured, a second BHA (not shown) is connected to the wireline 29 and the seal head and deployed to the pressure control head. The second BHA includes a cablehead, a collar locator, a setting tool, and a lower bridge plug 32*b*. The second BHA is deployed to a depth adjacent to and above the lower cement plug 31*b*. Once the second BHA has been deployed to the setting depth, electrical power is supplied to the second BHA through the wireline 29 to operate the setting tool, thereby expanding the lower bridge plug 32*b* (FIG. 2C) against an inner surface of the production tubing 7*t*. Once the lower bridge plug 32*b* has been set, it is released from the setting tool. The setting tool is then retrieved to the seal head and the seal head and setting tool are dispatched from the pressure control head to the vessel 21.

The BHA is then redeployed to the pressure control head and into the wellbore 2 using the wireline 29. The BHA is redeployed to a depth below a shoe of the intermediate casing string 5 and above a top of the production casing cement 8*p*. Once the BHA has been deployed to the setting depth, electrical power is then supplied to the BHA via the wireline 29 to fire the perforating guns into the production tubing 7*t*, thereby forming upper perforations 30*u* through a wall thereof. The BHA is retrieved to the seal head and the seal head and BHA dispatched from the pressure control head to the vessel 21.

Cement slurry (not shown) is then pumped from the vessel 21, through pressure control head, down the production tree 15 and production tubing 7*t*, and into the tubing annulus 7*a* via the upper perforations 30*u* (FIG. 2C). Wellbore fluid displaced by the cement slurry flows up the tubing annulus 7*a*, through the wellhead 10, tree annulus port, and to the vessel 21. Once a desired quantity of cement slurry has been pumped, the cement slurry is allowed to cure, thereby forming an upper cement plug 31*u* (FIG. 2C).

Once the upper cement plug 31*u* has cured, the second BHA is reconnected to the wireline 29 and seal head and redeployed to the pressure control head. The second BHA is redeployed to a depth adjacent to and above the upper cement plug 31*u*. Once the second BHA has been deployed to the setting depth, the upper bridge plug 32*u* (FIG. 2C) is set against the inner surface of the production tubing 7*t*. Once the upper bridge plug 32*u* has been set, the plug is released from the setting tool and the second BHA is then retrieved to the seal head and the seal head is dispatched from the pressure control head to the vessel 21.

A third BHA (not shown) is then connected to the wireline 29 and seal head and deployed to the pressure control head. The third BHA includes a cablehead, a collar locator, an anchor, a hydraulic power unit (HPU), an electric motor, and a tubing cutter. The third BHA is deployed into the production tubing string 7 to a depth adjacent to and above the upper bridge plug 32*u*. Once the third BHA has been deployed to the cutting depth, the HPU is operated by supplying electrical power via the wireline 29 to extend blades of the tubing cutter and the motor operated to rotate the extended blades, thereby severing an upper portion of the production tubing string 7 from a lower portion thereof.

The third BHA is then retrieved to the seal head and the seal head and third BHA are dispatched from the pressure control head to the vessel 21. Once the third BHA and seal head have been retrieved to the vessel 21, the pressure control head is disconnected from the tree 15 and retrieved to the vessel. A tree grapple (not shown) is connected to the wire rope 25 and lowered from the vessel 21 into the sea 1 via the moon pool 23. The ROV 20 may guide landing of the tree grapple onto the tree 15. The ROV 20 then operates a connector of the tree grapple to fasten the grapple to the tree 15. The ROV 20 then disengages the tree connector 13 from the wellhead 10 and the production tree 15 and the severed upper portion of the production tubing string 7 is lifted to the vessel 21 by operating the winch 24, leaving the lower portion of the production tubing string 7 in place as shown in FIGS. 2C and 2D.

Once the production tree 15 has been retrieved to the vessel 21, a fourth BHA 34 is connected to the wireline 29 and deployed through moonpool 23 to the subsea wellhead 10. The fourth BHA 34 includes a cablehead, a collar locator, a setting tool, and the lower bridge plug 33*b*. The setting tool includes a mandrel and a piston longitudinally movable relative to the mandrel. The setting mandrel is connected to the collar locator and fastened to a mandrel of the lower bridge plug 33*b*, such as by a shearable fastener. The setting tool may include a firing head and a power charge. The firing head receives electrical power from the wireline 29 to operate an electric match (ignitor) thereof and fire the power charge. Combustion of the power charge creates high pressure gas which exerts a force on the setting piston. The lower bridge plug 33*b* includes a mandrel, an anchor, and a packing element. The mandrel and anchor is made from a metal or alloy, such as cast iron, and the packing element is made from an elastomer or elastomeric copolymer. The anchor and packing element is disposed along an outer surface of the plug mandrel between a setting shoulder of the mandrel and a setting ring. The setting piston engages the setting ring and drives the packing and anchor against the setting shoulder, thereby setting the lower bridge plug 33*b*.

The fourth BHA 34 is lowered through the subsea wellhead 10 into the production casing 6*c* and deployed to a depth therein adjacent to and above the upper bridge plug 32*u*. Once the fourth BHA 34 has been deployed to the setting depth, electrical power is then supplied to the BHA via the wireline 29 to operate the setting tool, thereby expanding the lower bridge plug 33*b* against an inner surface of the production casing 6*c* as is shown in FIG. 2D. Once the lower bridge plug 33*b* has been set, the plug is released from the setting tool by exerting tension on (pulling upwardly on) the wireline 29 to fracture the shearable fastener. The fourth BHA 34 (minus the lower bridge plug 33*b*) is then retrieved to the vessel 21.

Figure 3A:
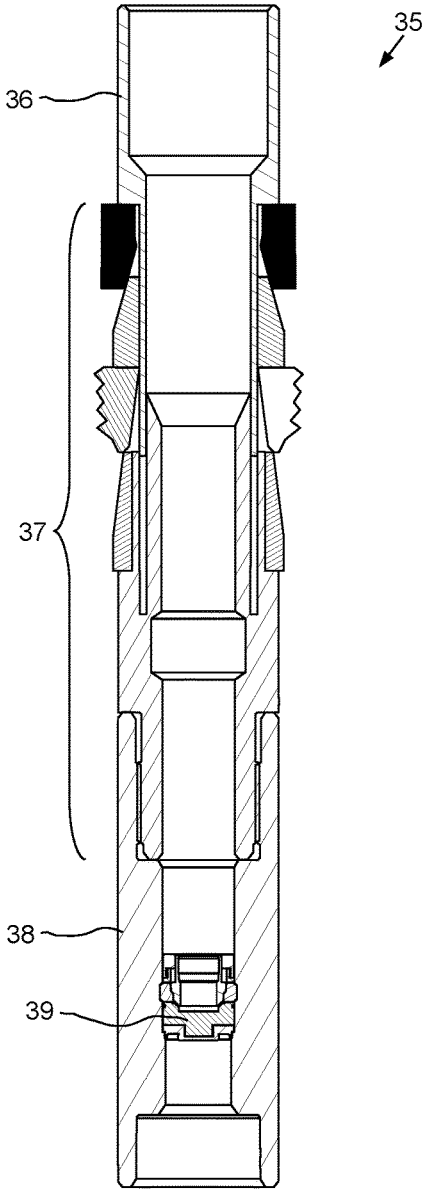
FIGS. 3A-3C illustrate a lower annulus cementing tool of the annulus cementing system.
Figure 3B:
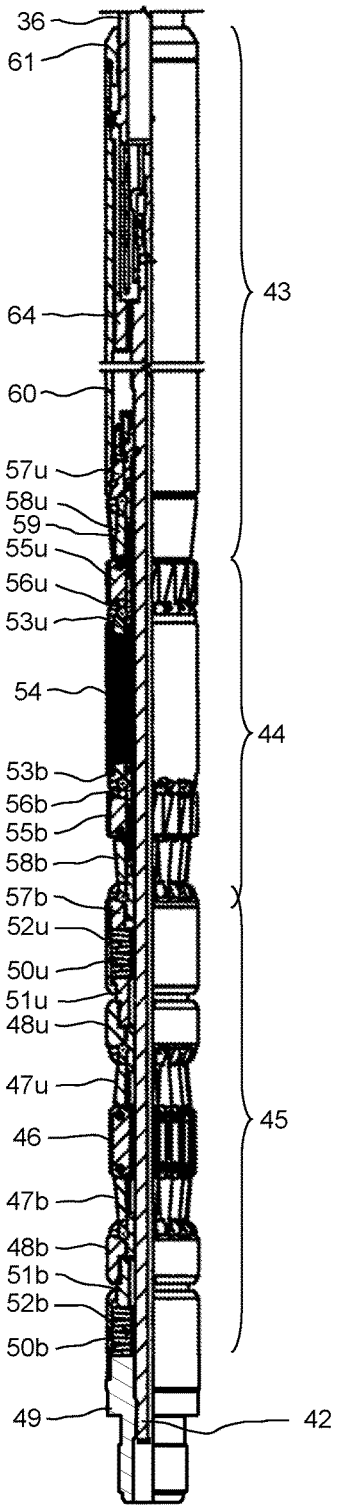
Figure 3C:
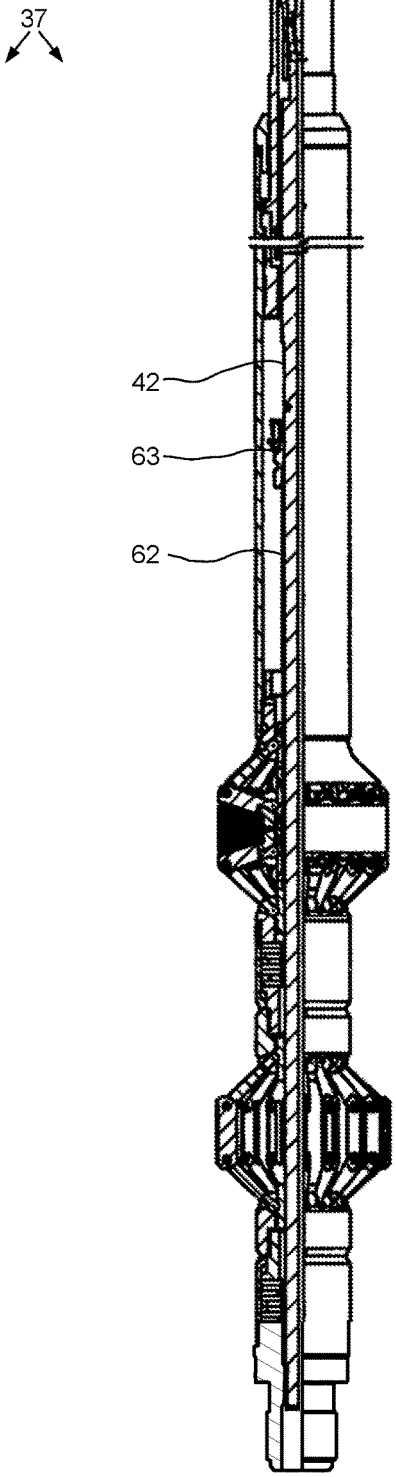

FIGS. 3A-3C illustrate a lower annulus cementing tool 35 of the annulus cementing system. The lower annulus cementing tool 35 includes a polished bore receptacle (PBR) 36, a packer 37 shown in FIG. 3A schematically, a nipple 38, and a bore plug 39. The PBR 36 is tubular, has seal bore formed at an upper end thereof, and has a coupling, such as a thread, formed adjacent to a lower end thereof.

Referring to FIGS. 3B and 3C, the packer 37 includes a mandrel 42, a setting unit 43, a packing unit 44 and an anchor unit 45. The anchor unit 45 includes a set of metallic grippers 46 radially movable between an extended position (FIG. 3C) and a retracted position (FIG. 3B) and having teeth formed on an outer surface thereof for engagement with an inner surface of the production casing 6*c*. A respective opposed end of each gripper 46 is fastened to respective upper 48*u* and lower 48*b* retainers via upper 47*u* and lower 47*b* pivotal links. The grippers 46 are longitudinally connected to the pivotal links 47*u,b*, such as by fasteners. The pivotal links 47*u,b* are longitudinally connected to the retainers 48*u,b*, such as by ball and socket joints. Each retainer 48*u,b* is a ring assembly disposed around an outer surface of the mandrel 42 and longitudinally movable relative thereto to extend or retract the grippers 46.

To guide the radial extension of the anchor unit 45, each pivotal link 47*u,b* has a cam profile formed in a face thereof adjacent to the grippers 46 and the grippers each have complementary cam profiles formed in upper and lower faces thereof. The anchor unit 45 is also arranged such that a slight inclination angle exists in the retracted position. The inclination angle is formed between a longitudinal axis of each pivotal link 47*u,b* and a transverse axis of the respective fastener connecting the link to the respective gripper 46.

The packer 37 further includes an adapter 49 connected to a lower end of the mandrel 42, such as by threads further secured with a fastener. The adapter 49 is tubular and has a coupling, such as a threaded box (not shown) or pin (shown), formed at a lower end thereof. A top ledge of the adapter 49 may serve as a stop shoulder for the anchor unit 45. The anchor unit 45 further includes upper 50*u* and lower 50*b* springs. Each spring 50*u,b* is a compression spring, such as a Belleville spring. The lower spring 50*b* includes a lower end bearing against a top of the adapter 49 and an upper end bearing against a bottom of a lower spring washer 51*b*. A spring chamber is formed radially between an outer surface of the mandrel 42 and an inner surface of a lower protector sleeve 52*b*. The lower protective sleeve 52*b* is connected to the adapter 49, such as by threaded couplings, and is coupled to the lower spring washer 51*b*, such as by a splice joint. The splice joint accommodates operation of the lower spring 50*b*. The lower spring washer 51*b* is connected to the lower link retainer 48*b*, such as by threaded couplings.

An upper spring washer 51*u* is connected to the upper link retainer 48*u*, such as by threaded couplings. An upper protective sleeve 52*u* is coupled to the upper spring washer 51*u*, such as by a splice joint. The upper spring 50*u* is disposed in a spring chamber formed between the upper protective sleeve 52*u* and the mandrel 42 and the splice joint may accommodate operation thereof. The upper spring 50*u* has a lower end bearing against a top of the upper spring washer 51*u*.

The packing unit 44 includes a packing element 54 and a pair of glands 53*u,b* straddling the packing element. Each longitudinal end of the packing element 54 is attached to respective gland 53*u,b*. The packing element 54 is made from an expandable material, such as an elastomer or elastomeric copolymer. The packing element 54 is naturally biased toward a contracted (non-radially expanded) position (FIG. 3B) and compression of the packing element between the glands 53*u,b* causes radial expansion (FIG. 3C) of the packing element into engagement with an inner surface of the production casing 6*c*, thereby isolating a lower portion of a working annulus 67 (FIG. 3E) formed between the lower cementing tool 37 and the production casing 6*c* from an upper portion thereof. The packing unit 44 may further include strands of fiber extending between the glands for reinforcing the packing element 54.

The packing unit 44 further includes upper 55*u* and lower 55*b* sets of backup rings located adjacent to the respective glands 53*u,b*. An end of each backup ring 55*u,b* adjacent to the respective gland 53*u,b* is longitudinally connected to respective sliders 56*u,b*, such as ball and socket joints. A distal end of each backup ring 55*u,b* is fastened to the respective upper 57*u* and lower 57*b* retainers via upper 58*u* and lower 58*b* pivotal links. The backup rings 55*u,b* are longitudinally connected to the pivotal links 58*u,b*, such as by fasteners. The pivotal links 58*u,b* are longitudinally connected to the retainers 57*u,b*, such as by ball and socket joints. Each retainer 57*u,b* is a ring assembly disposed around an outer surface of the mandrel 42 and longitudinally movable relative thereto.

The upper spring 50*u* has an upper end bearing against a bottom of the lower link retainer 57*b*. The upper protective sleeve 52*u* is connected to the lower link retainer 57*b*, such as by threaded couplings. The packing unit 44 further includes a flexible shroud 59 covering the upper pivotal links 58*u*. The shroud 59 has a bead formed in an inner surface thereof received in a groove formed in an outer surface of the upper link retainer 57*u*, thereby longitudinally connecting the two members. Each backup ring 55*u,b* includes a support face for receiving a respective end face of the packing element 54 in the expanded position and a pocket for receiving an end face of the respective gland 53*u,b* in the expanded position.

The setting unit 43 includes an outer sleeve 60, a cap 61, an inner sleeve 62, an anchor lock 63, and a packing lock 64.

The cap 61 is connected to an upper end of the outer sleeve 60, such as by threaded couplings. The outer sleeve 60 has a coupling, such as a thread, for receiving the threaded lower end of the PBR 36, thereby connecting the members. The mandrel 42 may have a latch profile formed in an inner surface thereof for engagement with a latch of a setting tool 65 (FIG. 3E). A lower end of the outer sleeve 60 is connected to the upper link retainer 57*u*, such as by threaded couplings.

The anchor lock 63 includes a body connected to an upper end of the inner sleeve 62, such as by threaded couplings, and releasably connected to the upper link retainer 57*u*, such as by a shearable fastener. The inner sleeve 62 is disposed between the mandrel 42 and the packing unit 44 and extends along an outer surface of the mandrel such that an outer lug formed at a lower end of the inner sleeve is located adjacent to the lower link retainer 57*b*. The packing lock 64 may include a ratchet ring connected to the outer sleeve 60 and a ratchet profile formed in an outer surface of the mandrel 42.

The anchor lock 63 further includes a friction disk disposed along a plurality (only one shown) of threaded fasteners engaged with respective threaded sockets formed in a top of the body. The body top is sloped and the fasteners have different lengths to accommodate the slopes. Each fastener carries a spring, such as a compression spring, bearing against an upper face of the friction disk and a head of the respective fastener. Each spring has a different stiffness such that the friction disk is biased toward a cambered position, thereby locking the inner sleeve 62 to the mandrel 42. The friction disk is initially held in a straight position by engagement with a top of the upper link retainer 57*u*, thereby allowing relative movement between the inner sleeve 62 and the mandrel 42.

The nipple 38 is tubular, have a coupling, such as a threaded box (shown) or pin (not shown), formed at an upper end thereof and in engagement with the adapter coupling, thereby connecting the nipple and the packer 37. The nipple 38 may also have a receiver profile formed in an inner surface thereof. The bore plug 39 may include a body with a metallic seal on its lower end. The metallic seal is a depending lip that engages the nipple receiver profile. The plug body has a plurality of windows which allow fasteners, such as dogs, to extend and retract. The dogs are pushed outward by an actuator, such as a central cam. The cam has a retrieval profile formed in an inner surface thereof. The cam moves between a lower locked position and an upper position freeing the dogs to retract. A retainer, such as a nut, connects to the upper end of the plug body to retain the cam. The extended dogs engage the nipple receiver profile to fasten the bore plug 39 to the nipple 38.

Figure 3D:
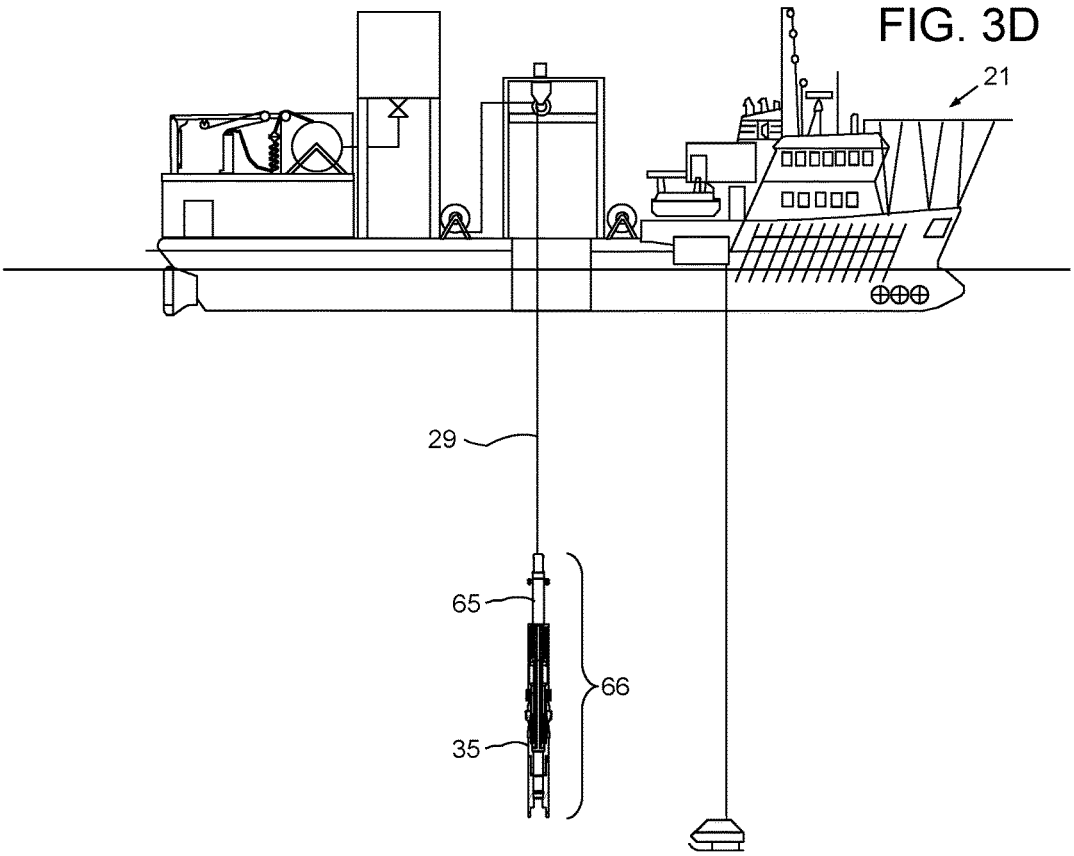
FIG. 3D illustrates deployment of the lower annulus cementing tool.
Figure 3D:
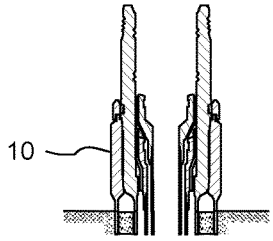
Figure 3E:
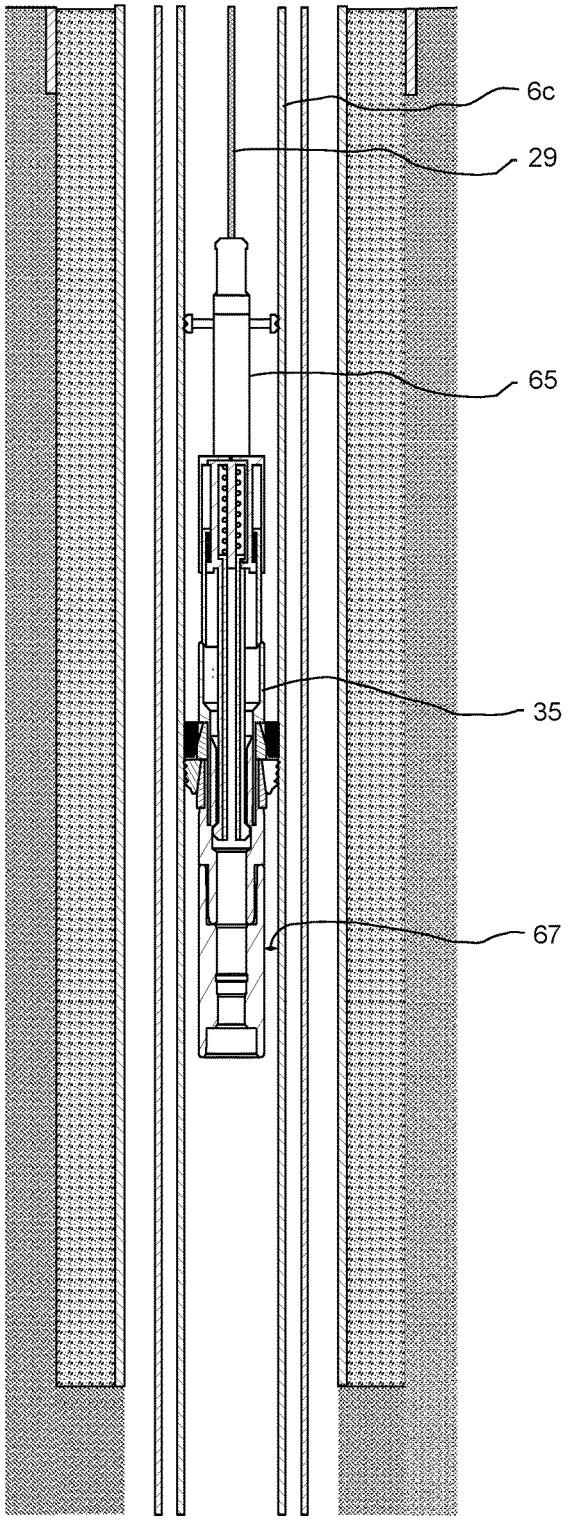
FIG. 3E illustrates setting of the lower annulus cementing tool in the production casing.

FIG. 3D illustrates delivery of the lower annulus cementing tool 35. FIG. 3E illustrates setting of the lower annulus cementing tool 35 in the production casing 6*c*. Once the lower bridge plug 33*b* has been set in the production casing 6*c*, a fifth BHA 66 is connected to the wireline 29 and deployed through the open sea 1 to the subsea wellhead 10 (FIG. 3D). The fifth BHA 66 includes a cablehead, a collar locator, the setting tool 65, and the lower annulus cementing tool 35 minus the bore plug 39.

The setting tool 65 is tubular and includes a stroker, an HPU, a cablehead, an anchor, and a latch. The stroker, HPU, cablehead, and anchor, may each include a housing connected, such as by threaded connections. The stroker may include the housing and a shaft. The cablehead includes an electronics package (not shown) for controlling operation of the setting tool 65. The electronics package includes a programmable logic controller (PLC) having a transceiver in communication with the wireline 29 for transmitting and receiving data signals to the vessel 21. The electronics package may also include a power supply in communication with the PLC and the wireline 29 for powering the HPU, the PLC, and various control valves. The HPU may include an electric motor, a hydraulic pump, and a manifold. The manifold is in fluid communication with the various setting tool components and includes one or more control valves for controlling the fluid communication between the manifold and the components. Each control valve actuator is in communication with the PLC. The cablehead connects the setting tool 65 to the wireline 29. The anchor may include two or more radial piston and cylinder assemblies and a die connected to each piston or two or more slips operated by a slip piston.

A housing of the latch is fastened to the stroker shaft, such as by a threaded connection. The latch further includes a fastener, such as a collet, connected to an end of the housing. The latch further includes a locking piston disposed in a chamber formed in the housing and operable between a locked position in engagement with the collet and an unlocked position disengaged from the collet. The locking piston is biased toward the locked position by a spring, such as a compression spring. The locking piston is in fluid communication with the HPU via a passage formed through the housing, a passage (not shown) formed through the shaft and via a hydraulic swivel (not shown) disposed between the stroker housing and shaft. The latch further includes a release piston disposed in a chamber formed in the housing and operable between an extended position in engagement with the latch profile of the packer mandrel 42 and a retracted position to allow disengagement of the collet. The release piston is biased toward the retracted position by a spring member, such as a compression spring. The release piston is also in fluid communication with the HPU via a passage formed through the housing, a second passage (not shown) formed through the shaft and via the hydraulic swivel.

The fifth BHA 66 is lowered though the subsea wellhead 10 and along the production casing 6*c* to a depth above the lower bridge plug 33*b*. Once the fifth BHA 66 has been deployed to the setting depth, electrical power is supplied to the BHA via the wireline 29 to operate the setting tool 65, thereby setting the anchor thereof and operating the stroker to push the PBR 36, the setting unit 43, the packing unit 44, and an upper portion of the anchor unit 45 downward along the mandrel 42 which is held stationary by the engaged setting tool anchor. Once the grippers 46 have been extended against an inner surface of the production casing 6*c*, the shearable fastener of the setting unit 43 fractures, thereby releasing the packing unit 44 from the anchor unit. The PBR 36, outer sleeve 60, and an upper portion of the packing unit 44 continue to be pushed downward until the packing element 54 has expanded against the inner surface of the production casing 6*c*.

Once the packer 37 has been set, the lower annulus cementing tool 35 is released from the setting tool 65 by operation of the release piston and retraction of the stroker. The setting tool anchor is then released and the fifth BHA 66 (minus the lower annulus cementing tool 35) retrieved to the vessel 21.

Figure 4A:
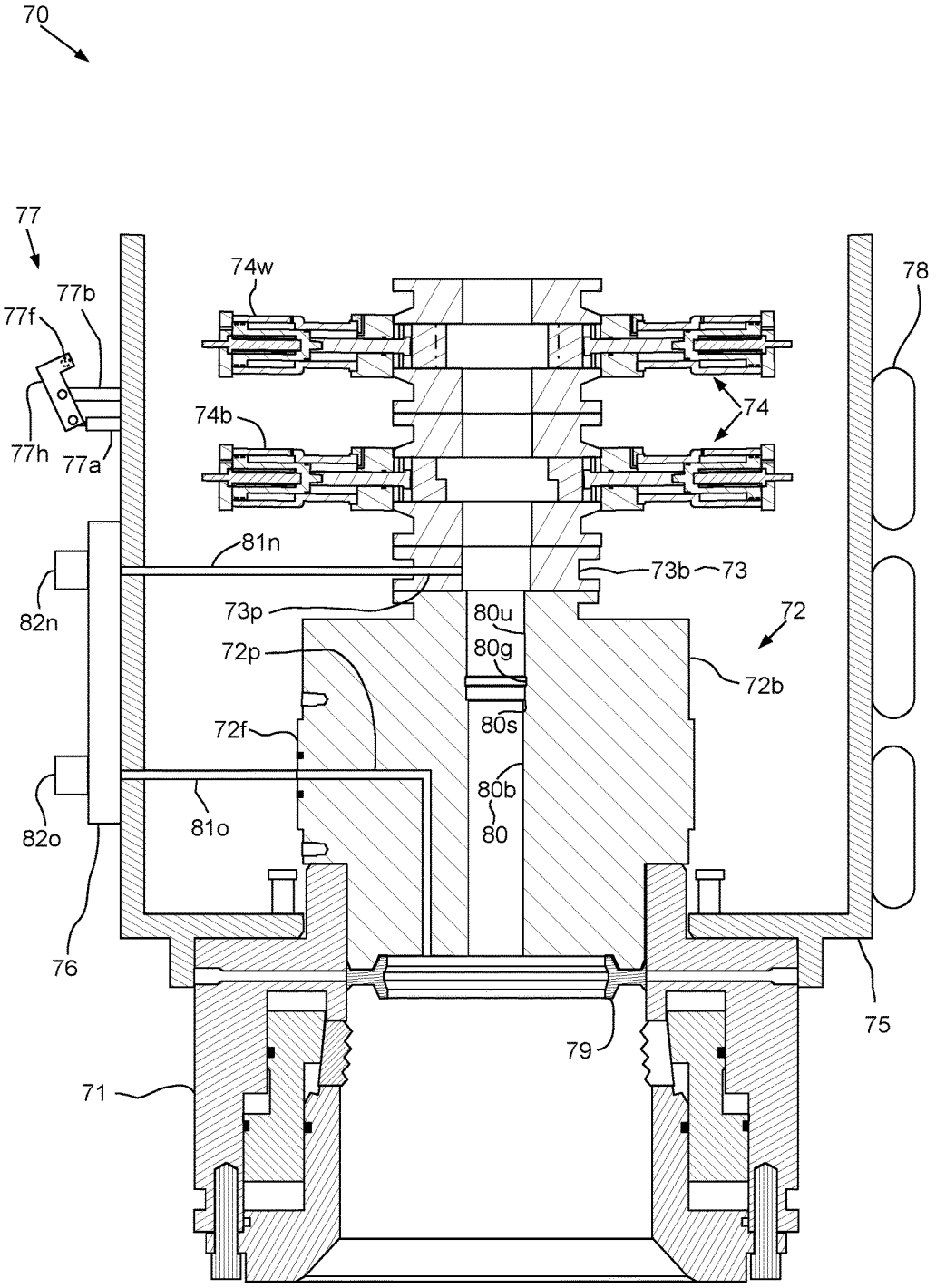
FIG. 4A illustrates a pressure control assembly (PCA) of the annulus cementing system.

FIG. 4A illustrates a pressure control assembly (PCA) 70 of the annulus cementing system. The PCA 70 includes a wellhead connector 71, a wellhead adapter 72, a fluid sub 73, a BOP stack 74, a frame 75, a manifold 76, a termination receptacle 77, one or more (three shown) accumulators 78, a face seal 79 and a subsea control system.

The wellhead connector 71 includes a fastener, such as dogs, for fastening the PCA 70 to an external profile of the subsea wellhead 10. The wellhead connector 71 further includes an electric or hydraulic actuator and an interface, such as a hot stab, so that the ROV 20 may operate the actuator for engaging the dogs with the external profile. The frame 75 is connected to the wellhead connector 71, such as by fasteners (not shown). The manifold 76 is fastened to the frame 75.

Figure 5A:
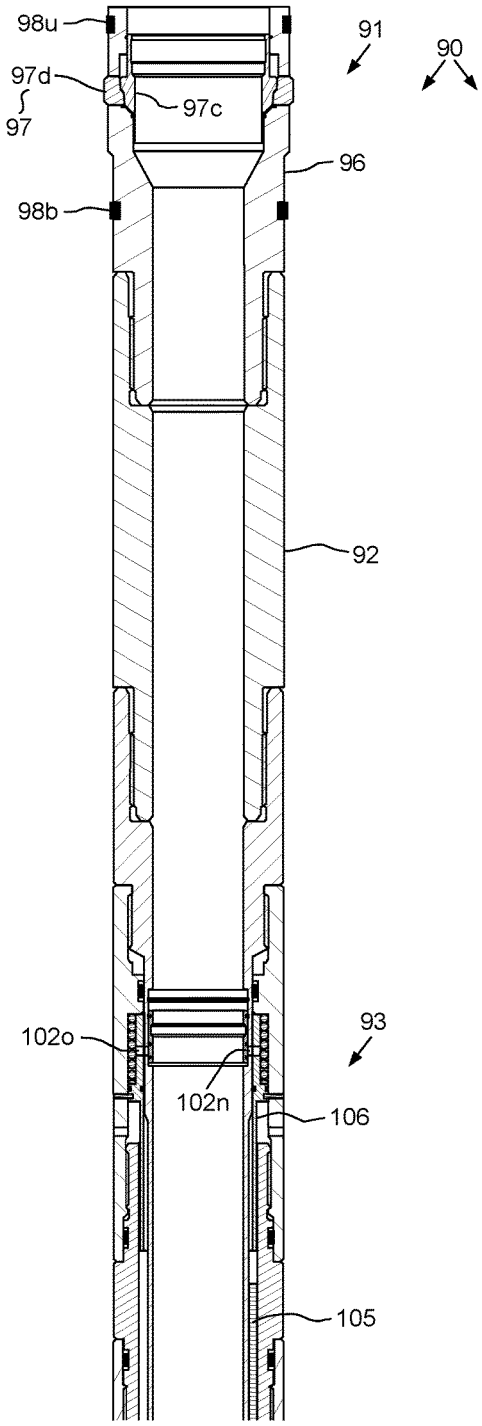
FIGS. 5A and 5B illustrate an upper annulus cementing tool of the annulus cementing system.
Figure 5B:
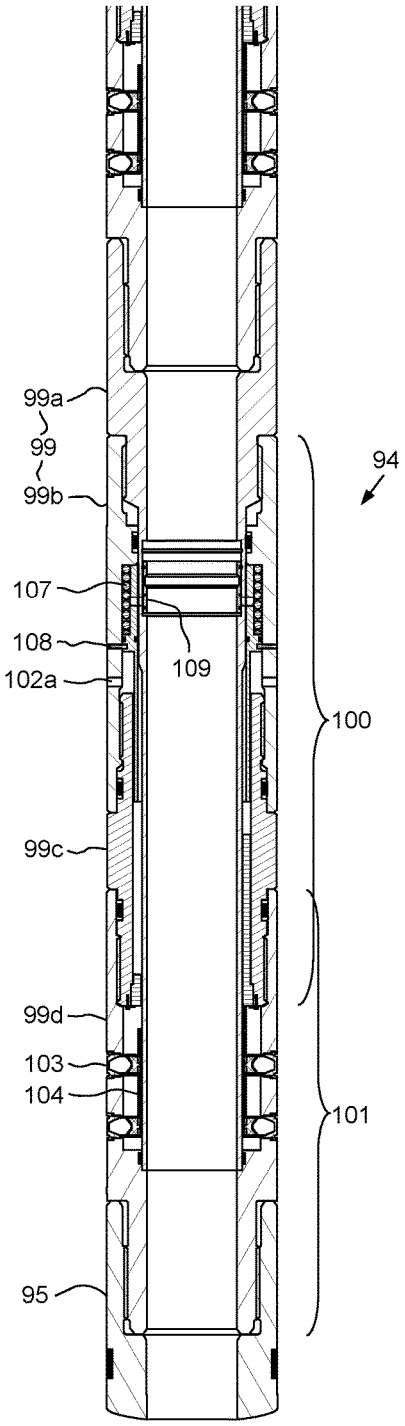

The wellhead adapter 72, fluid sub 73, and BOP stack 74 each include a body 72*b*, 73*b* having a longitudinal bore therethrough and be connected, such as by flanges, such that a continuous bore is maintained therethrough. The bore is sized to accommodate an upper annulus cementing tool 90 (FIGS. 5A and 5B). The adapter body 72*b* may have couplings at each longitudinal end thereof. The upper coupling is a flange for connection to the fluid sub 73 and the lower coupling is threaded for connection to the wellhead connector 71. The adapter body 72*b* also has a seal face formed in a bottom thereof for receiving the face seal 79, may have another seal face 72*f* formed in a side thereof, and a flow passage 72*p* formed in a wall thereof. The adapter body 72*b* further includes a landing profile 80 formed in an inner surface thereof for receiving a hanger 91 (FIG. 5A) of the upper annulus cementing tool 90. The landing profile 80 includes a landing shoulder 80*s* a latch profile, such as a groove 80*g*, and one or more seal bores, such as upper seal bore 80*u* and lower seal bore 80*b*.

The flow passage 72*p* may provide fluid communication between the seal face 72*f* and the subsea wellhead 10. A fluid conduit 81*o* connects to the seal face 72*f* and the manifold 76 and provide fluid communication between the flow passage 79 and an outlet coupling 82*o* of an outlet dry break connection 83*o* (FIG. 4C). The fluid sub 73 includes a port 73*p* formed through the body 73*b* thereof and communication with the bore. Another fluid conduit 81*n* connects to the fluid sub 73 and the manifold 76 and provides fluid communication between the fluid sub port 73*p* and an inlet coupling 82*n* of an inlet dry break connection 83*n* (FIG. 4C).

The BOP stack 74 include one or more hydraulically operated ram preventers, such as a blind-shear preventer 74*b* and a wireline preventer 74*w*, connected together via bolted flanges. Each ram preventer 74*b,w* includes two opposed rams disposed within each body thereof. Opposed cavities intersect the body bore and support the rams as they move radially into and out of the bore. A bonnet is connected to the respective body on the outer end of each cavity and supports an actuator that provides the force required to move the rams into and out of the bore. Each actuator includes a hydraulic piston to radially move each ram and a mechanical lock to maintain the position of the ram in case of hydraulic pressure loss. The lock may include a threaded rod, a motor (not shown) for rotationally driving the rod, and a threaded sleeve. Once each ram is hydraulically extended into the bore, the motor is operated to push the sleeve into engagement with the piston. Each actuator may include single or dual pistons. The blind-shear preventer 74*b* will cut the wireline 29 when actuated and seal the body bore. The wireline preventer 74*w* seals against an outer surface of wireline 29 when actuated.

The termination receptacle 77 is operable to receive a termination head 84*h* (FIG. 4C) of a subsea control line 84*u*. The termination receptacle 77 includes a base 77*b*, a latch 77*h*, and an actuator 77*a*. The receptacle base 77*b* is connected to the frame 75, such as by fasteners, and may include a landing plate for supporting the termination head 84*h*, a landing guide (not shown), such as a pin, and a stab plate. The receptacle stab plate and termination head 84*h*, when connected (termination assembly), may provide communication, such as electric (power and/or data), hydraulic, and/or optic, between the subsea control line 84*u* (FIG. 4C) and the subsea control system. The subsea control system is mounted on the PCA 70 or a subsea skid or is integrated with the termination head 84*h*. The receptacle latch 77*h* is pivoted to the base 77*b*, such as by a fastener, and is movable by the actuator 77*a* between an engaged position (FIG. 4C) and a disengaged position (shown). The receptacle actuator 77*a* is a piston and cylinder assembly connected to the frame 75 and the receptacle 77 further includes an interface (not shown), such as a hot stab, so that the ROV 20 may operate the receptacle actuator. The receptacle actuator 77*a* is also in communication with the stab plate for operation via the subsea control line 84*u*. The receptacle latch 77*h* includes outer members and a crossbar (not shown) connected to each of the outer members by a shearable fastener 77*f*. The receptacle actuator 77*a* is dual function so that the latch is locked in either of the positions by either the ROV 20 or the control line.

Figure 4B:
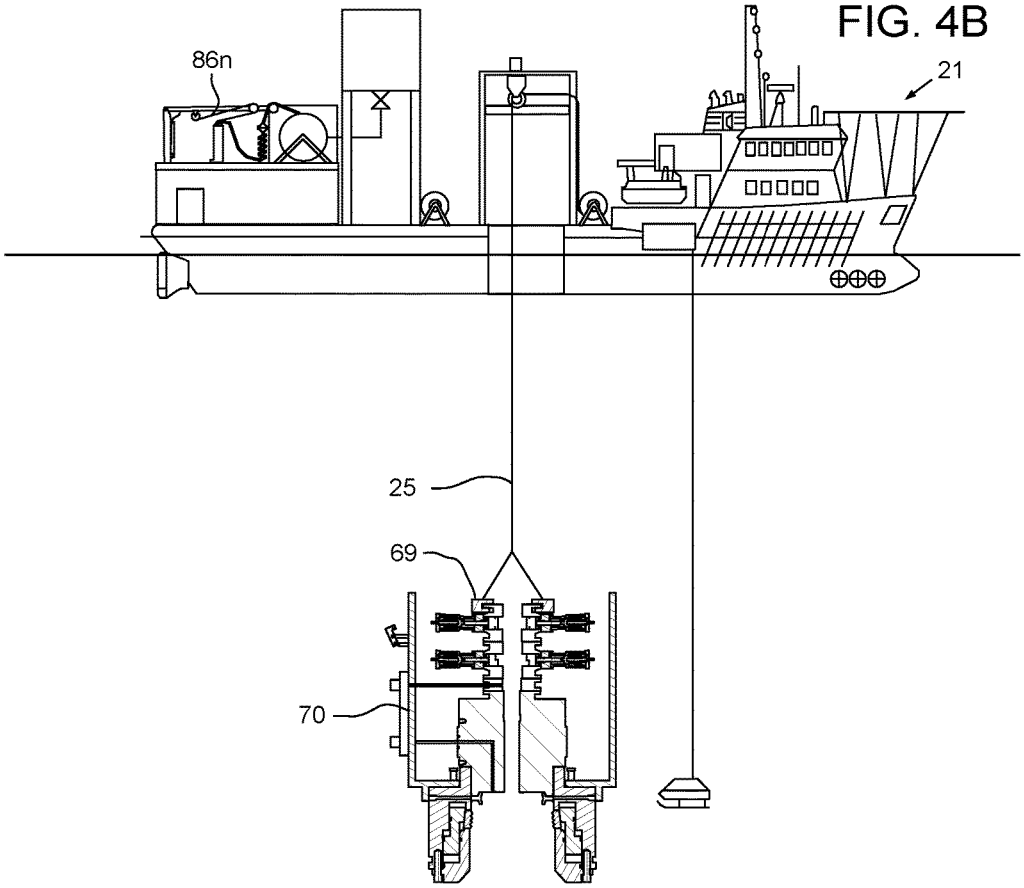
FIG. 4B illustrates deployment of the PCA.
Figure 4B:
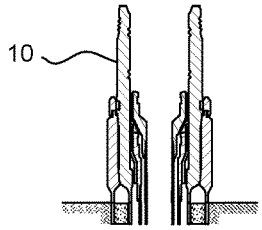
Figure 4C:
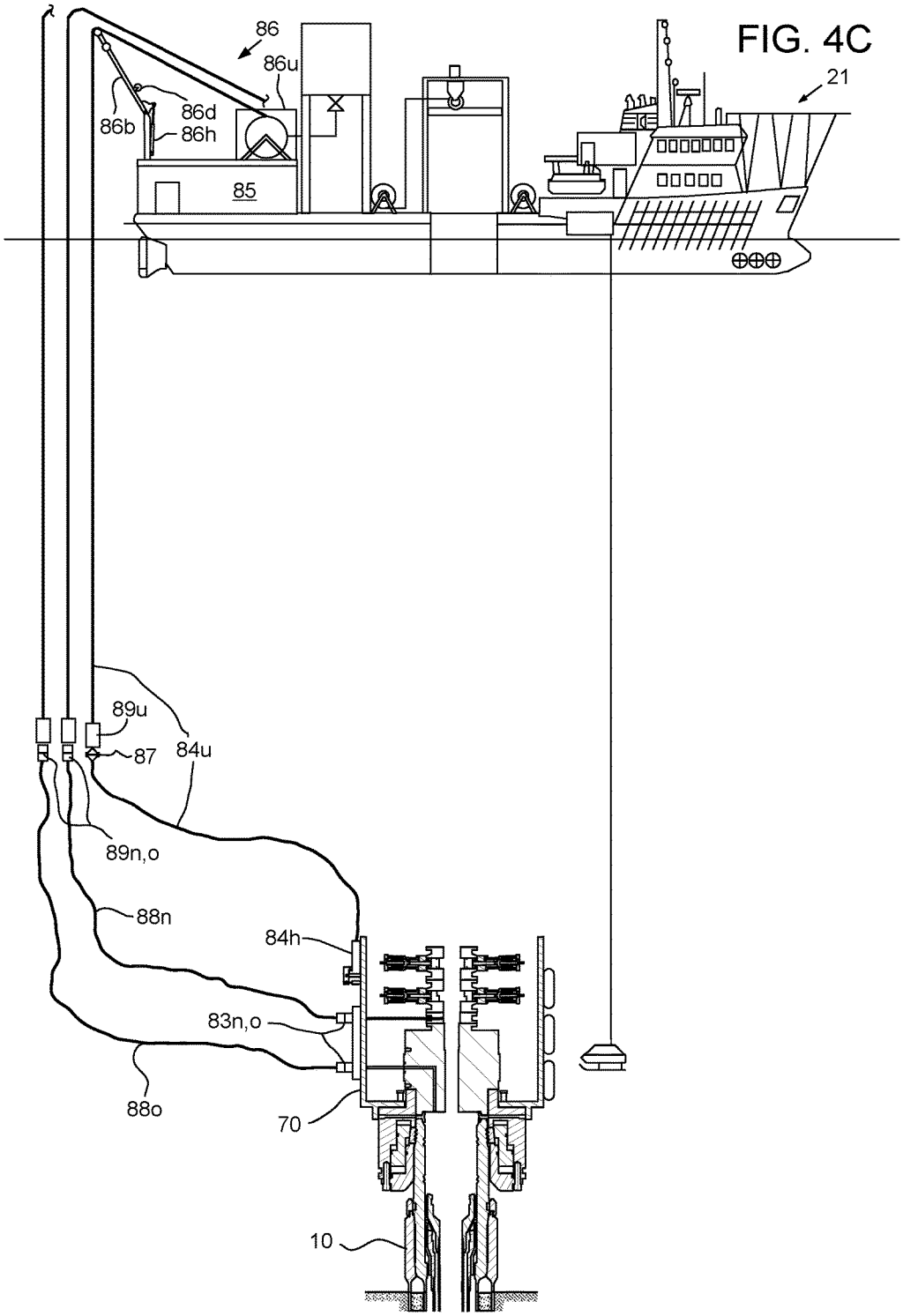
FIG. 4C illustrates installation of the PCA onto the subsea wellhead and connection of the PCA to the support vessel.

FIG. 4B illustrates deployment of the PCA 70. Once the packer 37 has been set, a grapple 69 is connected to the wire rope 25 and engaged with the PCA 70. The wire rope 25 is then used to lower the PCA 70 to the subsea wellhead 10 through the moonpool 23 of the vessel 21. The ROV 20 guides landing of the PCA 70 onto the wellhead 10. The ROV 20 then operates the wellhead connector 71 to fasten the PCA 70 to the subsea wellhead 10. The ROV 20 then operates the grapple to release the PCA 70.

FIG. 4C illustrates installation of the PCA 70 onto the subsea wellhead 10 and connection of the PCA to the support vessel 21. The subsea control system is in electric, hydraulic, and/or optic communication with a surface control system of a control van 85 onboard a support vessel 21 via the subsea control line 84*u*, such as an umbilical. The subsea control system further includes a control pod having one or more control valves (not shown) in communication with the BOP stack 74 (via the stab plate) for selectively providing fluid communication with the accumulators 78 for operation of the BOP stack. Each pod control valve includes an electric or hydraulic actuator in communication with the control line 84*u*. The accumulators 78 store pressurized hydraulic fluid for operating the BOP stack 74. Additionally, the accumulators 78 are used for operating one or more of the other components of the PCA 70. The accumulators 78 are charged via a conduit of the control line 84*u* or by the ROV 20.

The subsea control system further includes a PLC, a modem, a transceiver, and a power supply. The power supply receives an electric power signal from a power cable of the control line 84*u* and converts the power signal to usable voltage for powering the subsea control system components as well as any of the PCA components. The PCA 20 further includes one or more pressure sensors (not shown) in communication with the PCA bore at various locations. The modem and transceiver is used to communicate with the control van 85 via the control line 84*u*. The power cable is used for data communication or the control line 84*u* further includes a separate data cable (electric or optic). The control van 85 includes a control panel (not shown) so that the various functions of the PCA 20 are operated by an operator on the vessel 21.

The vessel 21 further includes a launch and recovery system (LARS) 86 for deployment of the termination head 84*h* and the control line 84*u*. The LARS 86 includes a frame, a control winch 86*u*, a boom 86*b*, a boom hoist 86*h*, a load winch 86*d*, and an HPU (not shown). The LARS 86 is the A-frame type (shown) or the crane type (not shown). For the A-frame type LARS 86, the boom 86*b* is an A-frame pivoted to the frame and the boom hoist 86*h* includes a pair of piston and cylinder assemblies, each piston and cylinder assembly pivoted to each beam of the boom and a respective column of the frame.

The control line 84*u* includes an upper portion and a lower portion fastened together by a shearable connection 87. Each winch 86*d,u* includes a drum having the respective control line 84*u* or load line 86*n* (FIG. 4B) wrapped therearound and a motor for rotating the drum to wind and unwind the control line portion or load line. The load line 86*n* is wire rope. Each winch motor is electric or hydraulic. A control sheave and a load sheave each hang from the boom 86*b*. The control line upper portion extends through the control sheave and an end of the control line upper portion is fastened to the shearable connection 87. The LARS 86 has a platform for the termination head 84*h* to rest. The control line lower portion is coiled and have a first end fastened to the shearable connection 87 and a second end fastened to the termination head 84*h*. The load line 86*n* extends through the load sheave and has an end fastened to the lifting lugs of the termination head 84*h*, such as via a sling. Pivoting of the A-frame boom 86*b* relative to the platform by the piston and cylinder assemblies lifts the termination head 84*h* from the platform, over a rail of the vessel 21, and to a position over the waterline 1*w*. The load winch 86*d* is then operated to lower the control line 84*u* and termination head 84*h* into the sea 1.

As the load winch 86*d* lowers the termination head 60, the control line lower portion uncoils and is deployed into the sea 1 until the shearable connection 87 is reached. Once the shearable connection 87 is reached, a clump weight 89*u* is fastened to a lower end of the control line upper portion. The termination head 84*h* may continue to be lowered using the load winch 86*d* until the shearable connection 87 and clump weight 89*u* are deployed from the LARS platform to over the waterline 1*w*. The control winch 86*u* is then operated to support the termination head 84*h* using the control line 84*u* and the load line 86*n* slacked. The load line 86*n* and sling is disconnected from the termination head 84*h* by the ROV 20. The termination head 84*h* is then lowered to a landing depth using the control winch 86*u*.

As the control line 84*u* is being lowered to the landing depth, the ROV 20 can grasp the termination head 84*h* and assist in landing the termination head in the termination receptacle 77. Once landed, the ROV 20 will operate the actuator 77*a* to engage the receptacle latch 77*h* with the termination head 84*h*.

An upper portion of each fluid conduit 88*n, o* is coiled tubing. The vessel 21 further includes a coiled tubing unit (CTU, not shown) for each fluid conduit 88*n,o*. Each CTU includes a drum having the coiled tubing wrapped therearound, a gooseneck, and an injector head for driving the coiled tubing, controls, and an HPU. A lower portion of each fluid conduit 88*n, o* includes a hose. The hose is made from a flexible polymer material, such as a thermoplastic or elastomer or is a metal or alloy bellows. An upper end of each hose is connected to the respective coiled tubing by a dry break connection 89*n, o* and a lower end of each hose may have a male coupling of the respective dry-break connection 83*n,o* connected thereto. During deployment of each fluid conduit 88*n,o*, a clump weight 89*n,o* is fastened to the lower end of the respective coiled tubing.

FIGS. 5A and 5B illustrate the upper annulus cementing tool 90 of the annulus cementing system. The upper annulus cementing tool 90 may include a hanger 91, an extender 92, one or more of perforators, such as perforating guns 93, 94, and a stinger 95. The perforating guns 93, 94 are disposed between the extender 92 and the stinger 95.

The hanger 91 includes a housing 96, a latch 97, and one or more stab seals 98*u,b*. The housing 96 is tubular and has a flow bore formed therethrough. A coupling, such as a threaded box (not shown) or pin (shown), is formed at a lower end of the housing 96 for connection with the extender 92. The housing 96 has seal grooves formed in an outer surface thereof straddling the latch 97 and the stab seals 98*u,b* are disposed in the respective seal grooves. Each stab seal 98*u,b* is made from an elastomer or elastomeric copolymer and be operable to engage a respective seal bore 80*u,b*.

The latch 97 is connected to the housing 96 at an upper end of the housing. The latch 97 includes an actuator, such as a cam 97*c*, and one or more fasteners, such as dogs 97*d*. The housing 96 has a plurality of windows formed through a wall thereof for extension and retraction of the dogs 97*d*. The dogs 97*d* are pushed outward by the cam 97*c* to engage the latch groove 80*g*, thereby longitudinally connecting the hanger 91 to the adapter 72. The cam 97*c* is longitudinally movable relative to the housing 96 between an engaged position (shown) and a disengaged position (not shown). In the engaged position, the cam 97*c* locks the dogs 97*d* in the extended position and in the disengaged position, the cam is clear of the dogs, thereby freeing dogs to retract. The cam 97*c* has an actuation profile formed in an outer surface thereof for pushing the dogs to the extended position, a latch profile formed in an inner surface thereof for engagement with a running tool 111 (FIG. 5C), and a seal sleeve for maintaining engagement of the cam with a seal of the latch 97 regardless of the cam position. The cam 97*c* also maintains engagement with another seal of the latch 97 regardless of the cam position. The latch 97 further includes an upper pickup shoulder formed in an inner surface of the housing 96 and engaged with the cam 97*c* when the cam is in the disengaged position and a lower landing shoulder formed in an outer surface of the housing 96 for seating against the landing shoulder 80*s*. The pickup shoulder is used for supporting the upper annulus cementing tool 90 when carried by the running tool 111.

Each perforating gun 93, 94 includes a housing 99, an igniter 100, and a charge carrier 101. Each housing 99 is tubular and has a flow bore formed therethrough. Each housing 99 includes two or more sections 99*a-d* connected together, such as by threaded couplings. Each housing 99 also has a coupling, such as a threaded pin or box, formed at each longitudinal end thereof for connection with the extender 92 or other perforating gun 93 at the upper end and for connection with the stinger 95 or other perforating gun 94 at the lower end. Each housing 99 also has one or more (two shown) annulus ports 102*a* formed through a wall of section 99*b*. Each perforating gun 93, 94 further include various seals disposed between various interfaces thereof such that a bore thereof is isolated from an exterior thereof.

Each charge carrier 101 may include a sleeve portion of housing section 99*a*, housing section 99*d*, one or more (four shown) shaped charges 103 and one or more detonation cords 104. The shaped charges 103 is arranged in one or more (two shown) sets, each set having a plurality of shaped charges circumferentially spaced around the housing section 99*d*. Each igniter 100 includes the housing sections 99*a-c*, a blasting cap 105, a firing piston 106, a spring 107, one or more (two shown) shearable fasteners 108, and an isolation sleeve 109.

A chamber is formed between the housing sections 99*a-c* and the blasting cap 105. The firing piston 106 and spring 107 are disposed in the chamber. The firing piston 106 commonly has a shoulder carrying an outer seal engaged with an inner surface of the housing section 99*b* and the piston carries an inner seal engaged with an outer surface of the housing section 99*a*, thereby isolating an upper portion of the chamber from a lower portion of the chamber. The spring 107 has an upper end bearing against the housing section 99*b* and a lower end bearing against the piston shoulder, thereby biasing the firing piston 106 toward a firing position (FIGS. 6F and 8F). The firing piston 106 is releasably restrained in a cocked position (shown) by the shearable fasteners 108 inserted into respective sockets formed through a wall of the housing section 99*b* and received by respective indentations formed in an outer surface of the piston shoulder, thereby releasably connecting the firing piston 106 and the housing 99.

Each of the firing piston 106 and housing section 99*a* have one or more (a pair shown) respective bore ports 102*n,o* formed through respective walls thereof. The bore ports 102*n,o* are initially closed by the isolation sleeve 109. The isolation sleeve 109 carries a pair of seals straddling the housing bore ports 102*n* and a detent engaged with a detent groove formed in an inner surface of the housing section 99*a*. The isolation sleeve 109 has a latch profile formed in an inner surface thereof for engagement with a shifting tool 119 (FIGS. 6E and 8E). The shifting tool 119 is used to move the isolation tool from a disarmed position (shown) to an armed position (FIGS. 6E and 8E), thereby exposing the bore ports 102*n, o* to the housing bore. The housing section 99*a* may have a second detent groove formed in an inner surface thereof for receiving the isolation sleeve detent in the armed position.

In operation, the shearable fasteners 108 have a strength sufficient to resist the biasing force of the cocked spring 107. Once the isolation sleeve has been moved to the armed position, the bore pressure is increased relative to the annulus pressure until a firing pressure differential is achieved. Once the bore pressure has been increased to the firing pressure differential, the firing piston 106 breaks the fasteners 108 and the spring 107 snaps the firing piston downward to strike the blasting cap 105. The blasting cap 105 then ignites the detonation cords 104 which fire the shaped charges 103.

The stinger 95 includes a body and a stab seal disposed in a seal groove formed in an outer surface of the body. The stinger body has a guide nose to facilitate stabbing into the PBR 36.

Figure 5C:
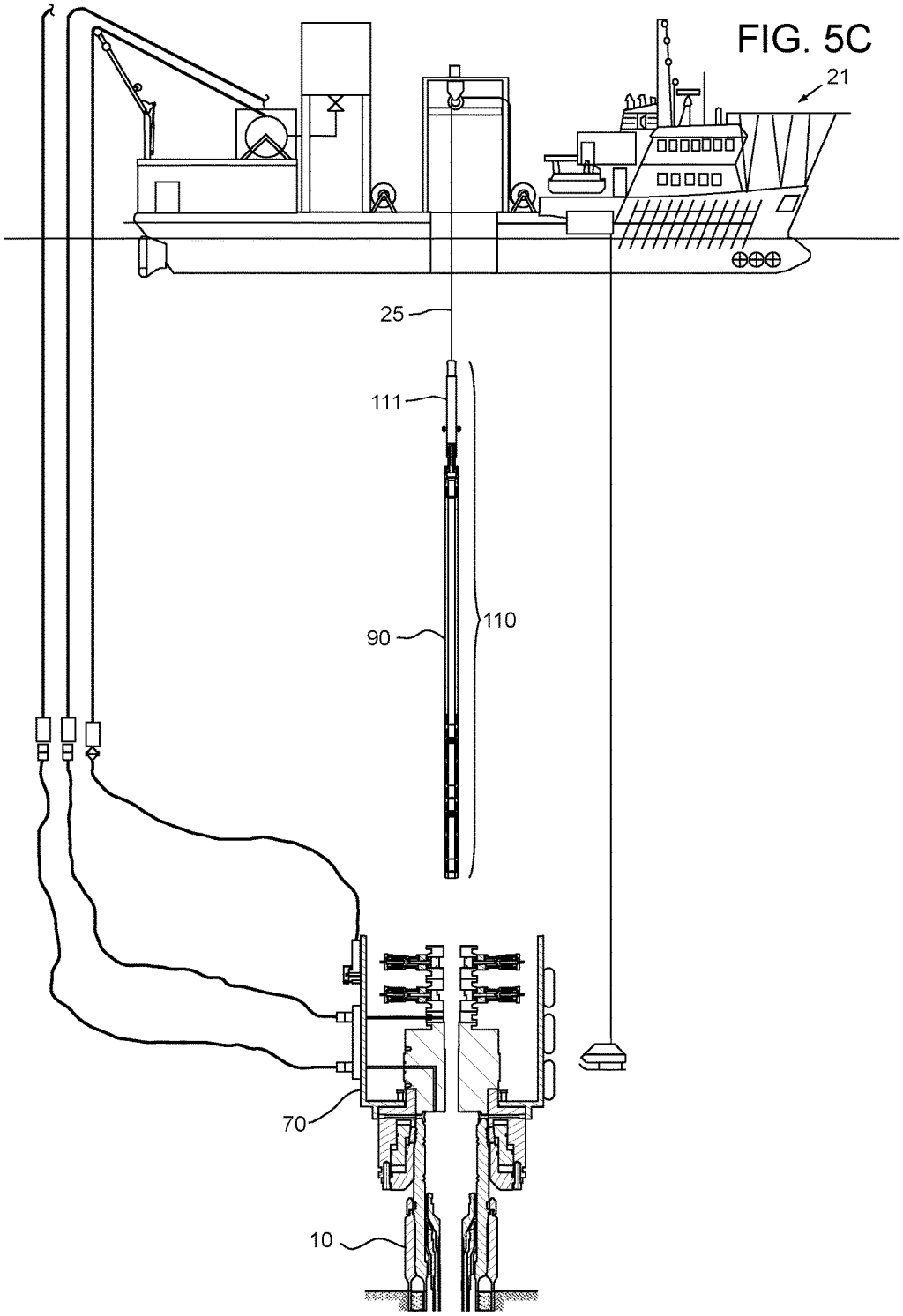
FIG. 5C illustrates deployment of the upper annulus cementing tool.
Figure 5D:
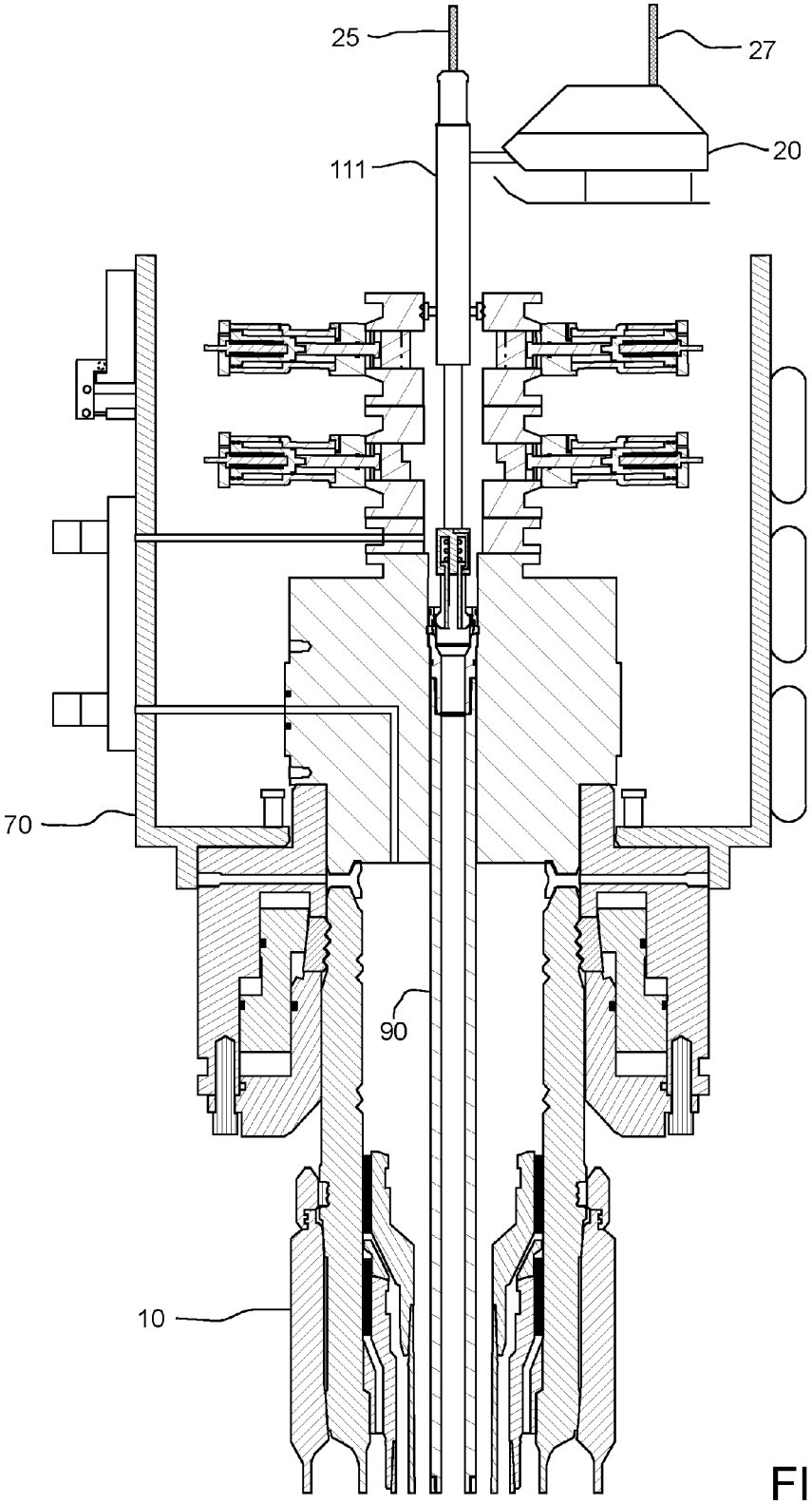
FIG. 5D illustrates hanging of the upper annulus cementing tool from the PCA.
Figure 5E:
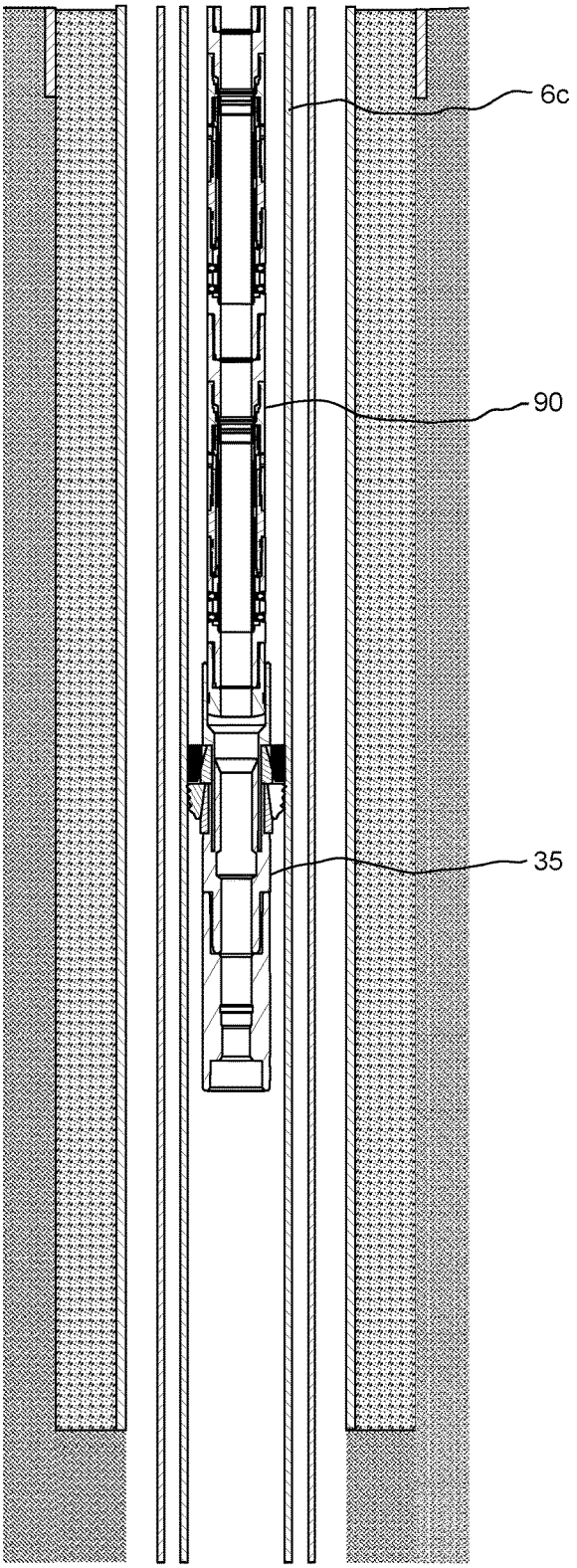
FIG. 5E illustrates stabbing of the upper annulus cementing tool into the lower annulus cementing tool.

FIG. 5C illustrates deployment of the upper annulus cementing tool 90. FIG. 5D illustrates hanging of the upper annulus cementing tool 90 from the PCA 70. FIG. 5E illustrates stabbing of the upper annulus cementing tool 90 into the lower annulus cementing tool 35. Once the PCA 70 has been installed onto the subsea wellhead 10 and connected to the support vessel 21, a sixth BHA 110 is connected to the wire rope 25 and deployed through the open sea 1 to the PCA 70. The sixth BHA 110 may include a cablehead, a collar locator, a running tool 111, and the upper annulus cementing tool 90.

The running tool 111 is a tubular and includes a stroker, an ROV interface, a cablehead, an anchor, and a latch. The stroker, ROV interface, cablehead, and anchor, may each include a housing connected, such as by threaded connections. The stroker includes the housing and a shaft. The ROV interface includes one or more hot stabs for operating the stroker, the anchor, and the latch. The cablehead connects the running tool 111 to the wire rope 25. The anchor includes two or more radial piston and cylinder assemblies and a die connected to each piston or two or more slips operated by a slip piston. The stroker, anchor, and latch of the running tool 111 is similar to those of the setting tool 65.

The ROV 20 is used to guide the stinger 95 into the PCA 70. The winch 24 is operated to lower the upper annulus cementing tool 90 through the PCA 70 until the hanger 91 is adjacent to the landing profile 80 and the stinger 95 is adjacent to the PBR 36. The ROV 20 is then connected to the running tool 111 via hot stab and supply hydraulic fluid to operate the anchor and stroker thereof, thereby setting the hanger 91 into the into the landing profile 80 and stabbing the stinger 95 into the PBR 36. The ROV 20 then operates the setting tool 111 to release the hanger 91, retract the stroker, and release the anchor. The ROV 20 will then disconnect from the running tool 111 and the sixth BHA 110 (minus the upper annulus cementing tool 90) is retrieved to the vessel 21.

Figure 5F:
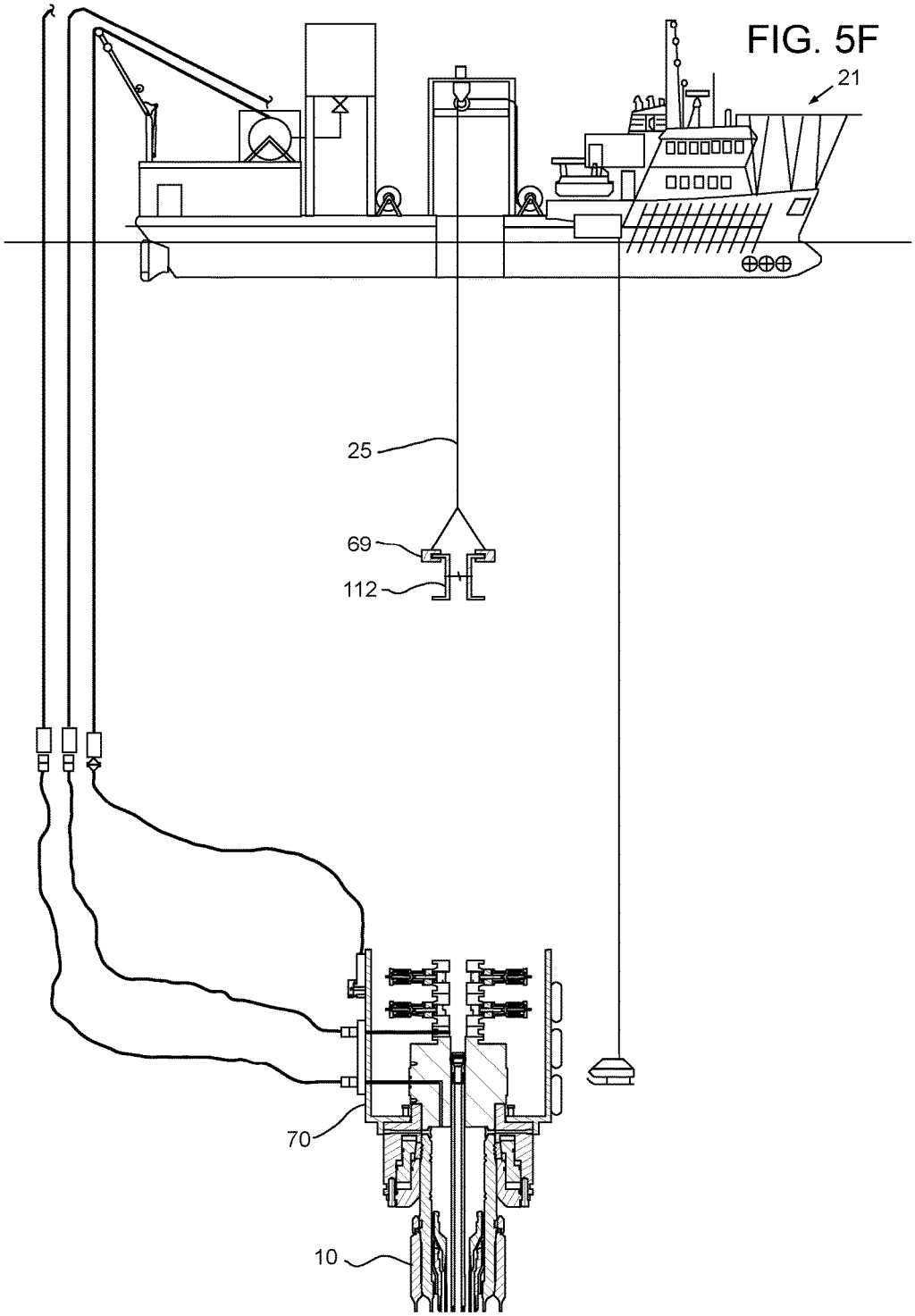
FIG. 5F illustrates deployment of a tool housing to the PCA.

FIG. 5F illustrates deployment of a tool housing 112 to the PCA 70. Once the upper annulus cementing tool 90 has been set, the grapple 69 is connected to the wire rope 25 and engaged with tool housing 112. The wire rope 25 is then used to lower the tool housing 112 to the subsea wellhead 10 through the moonpool 23 of the vessel 21. The ROV 20 guides the landing of the tool housing 112 onto the PCA 70. The ROV 20 then operates a PCA connector (not shown) of the tool housing 112 to fasten the tool housing to the PCA 70. The ROV 20 then operates the grapple to release the tool housing 112.

Figure 6A:
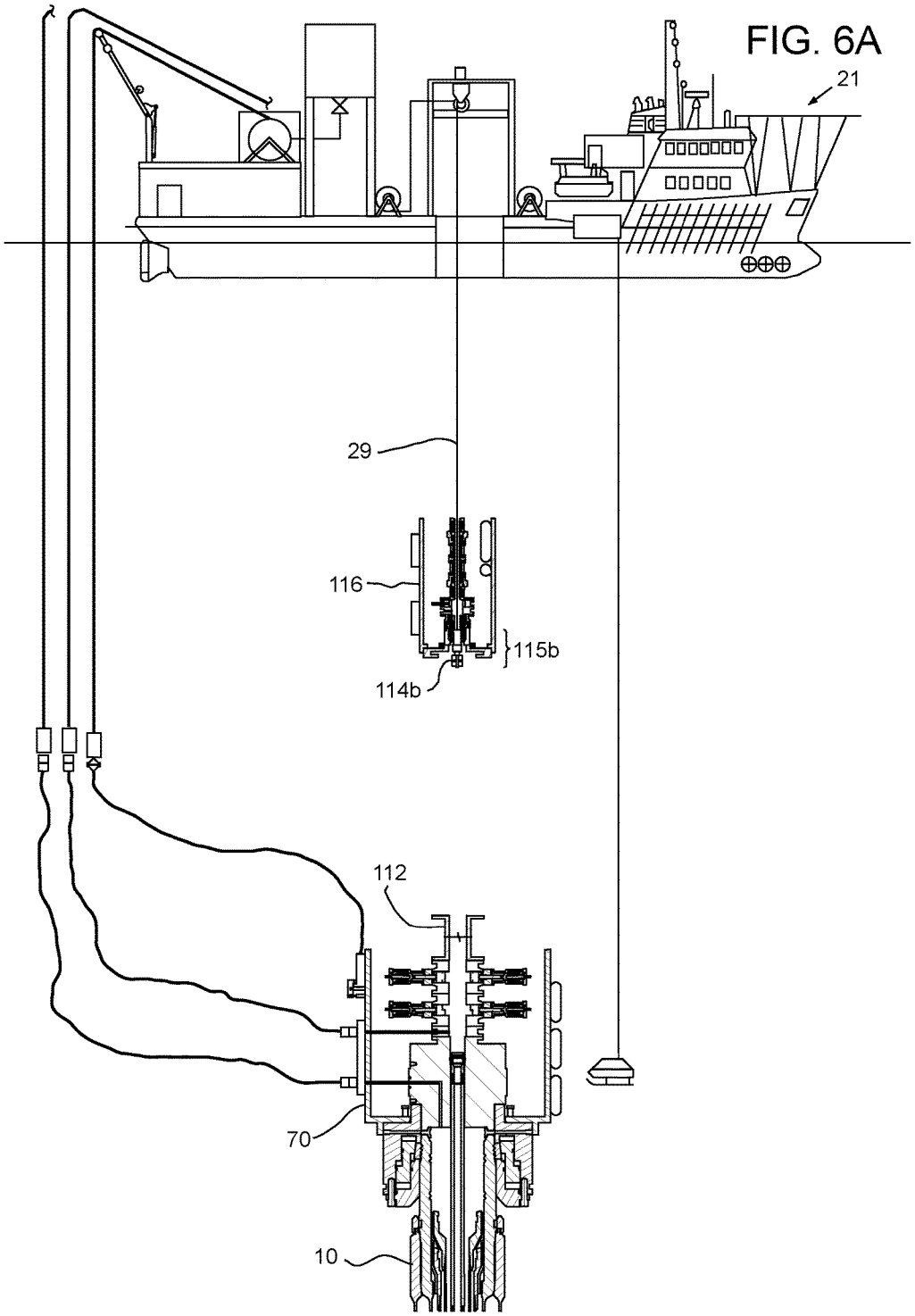
Figure 6B:
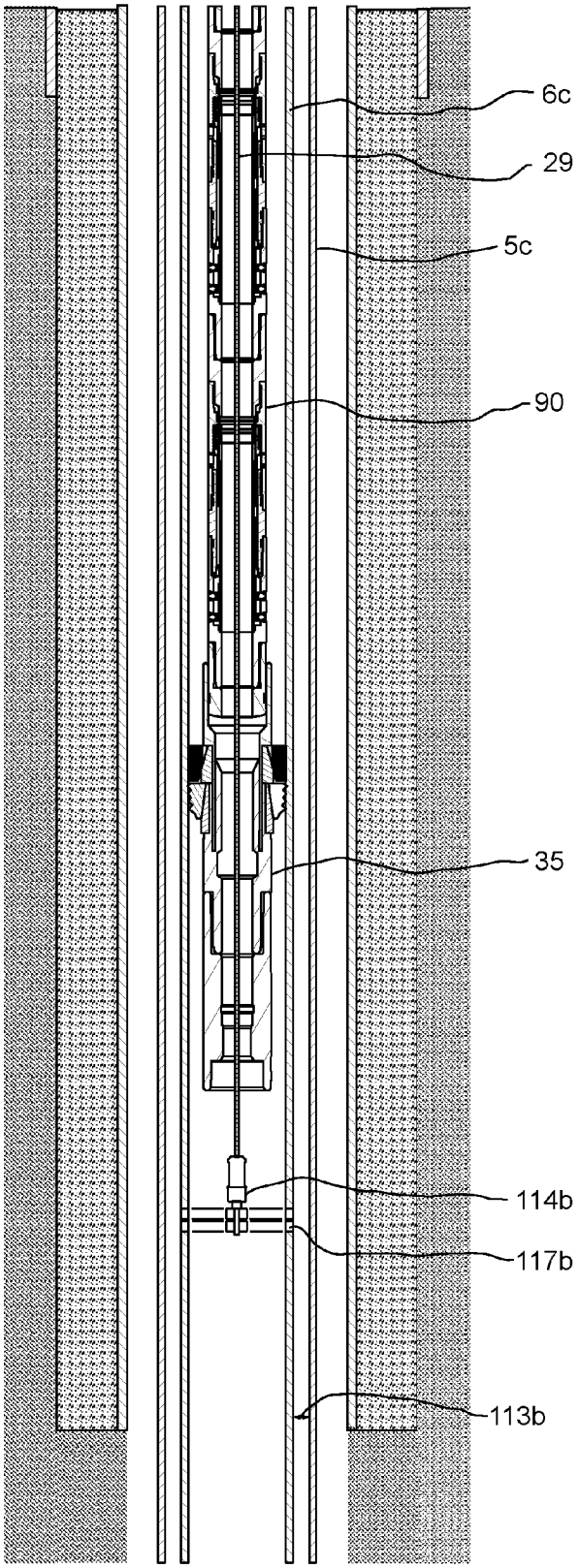
FIG. 6B illustrates firing of the lower perforating gun to perforate the production casing.
Figure 6C:
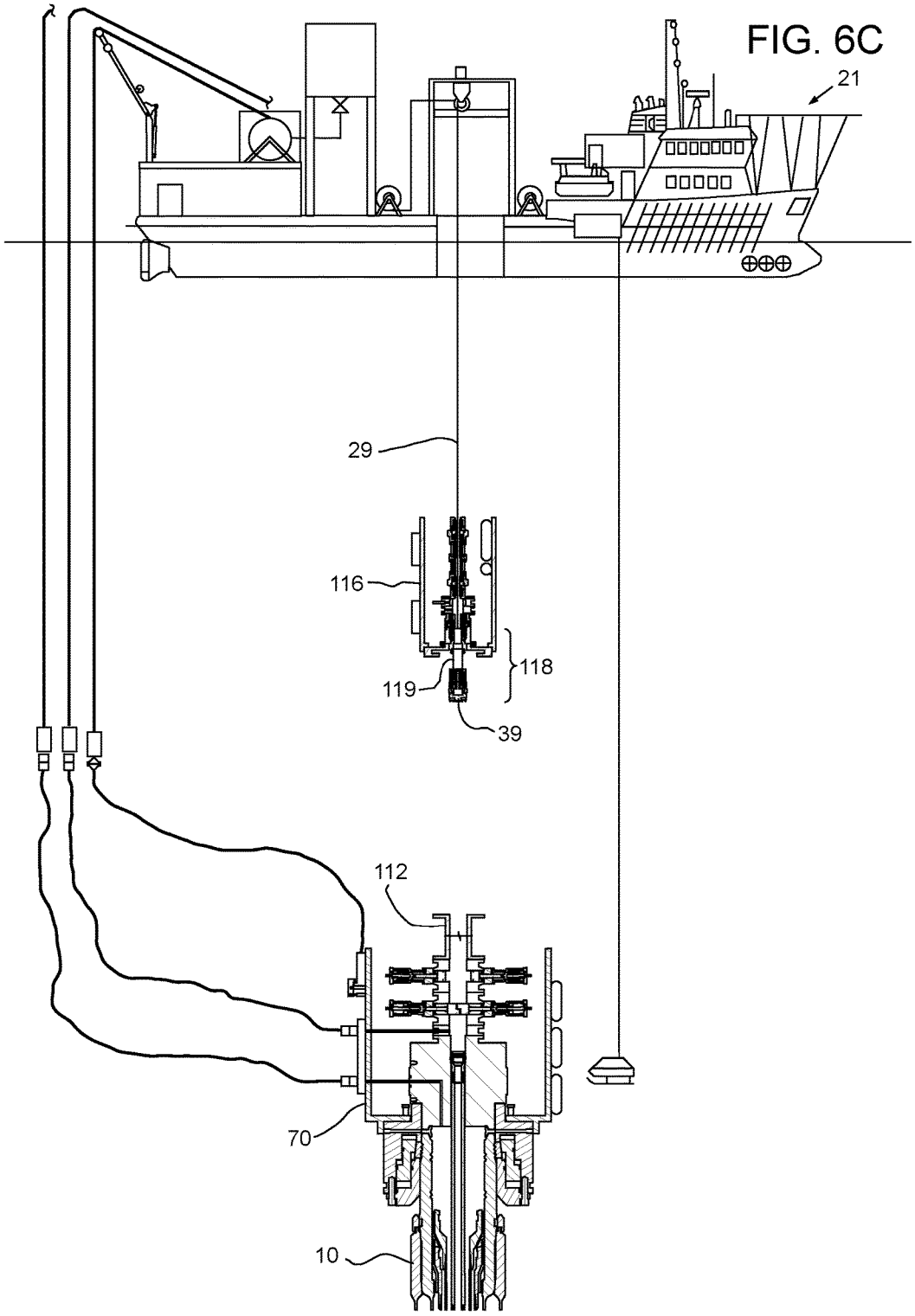
FIG. 6C illustrates deployment of a bore plug.
Figures 6D, 6E:
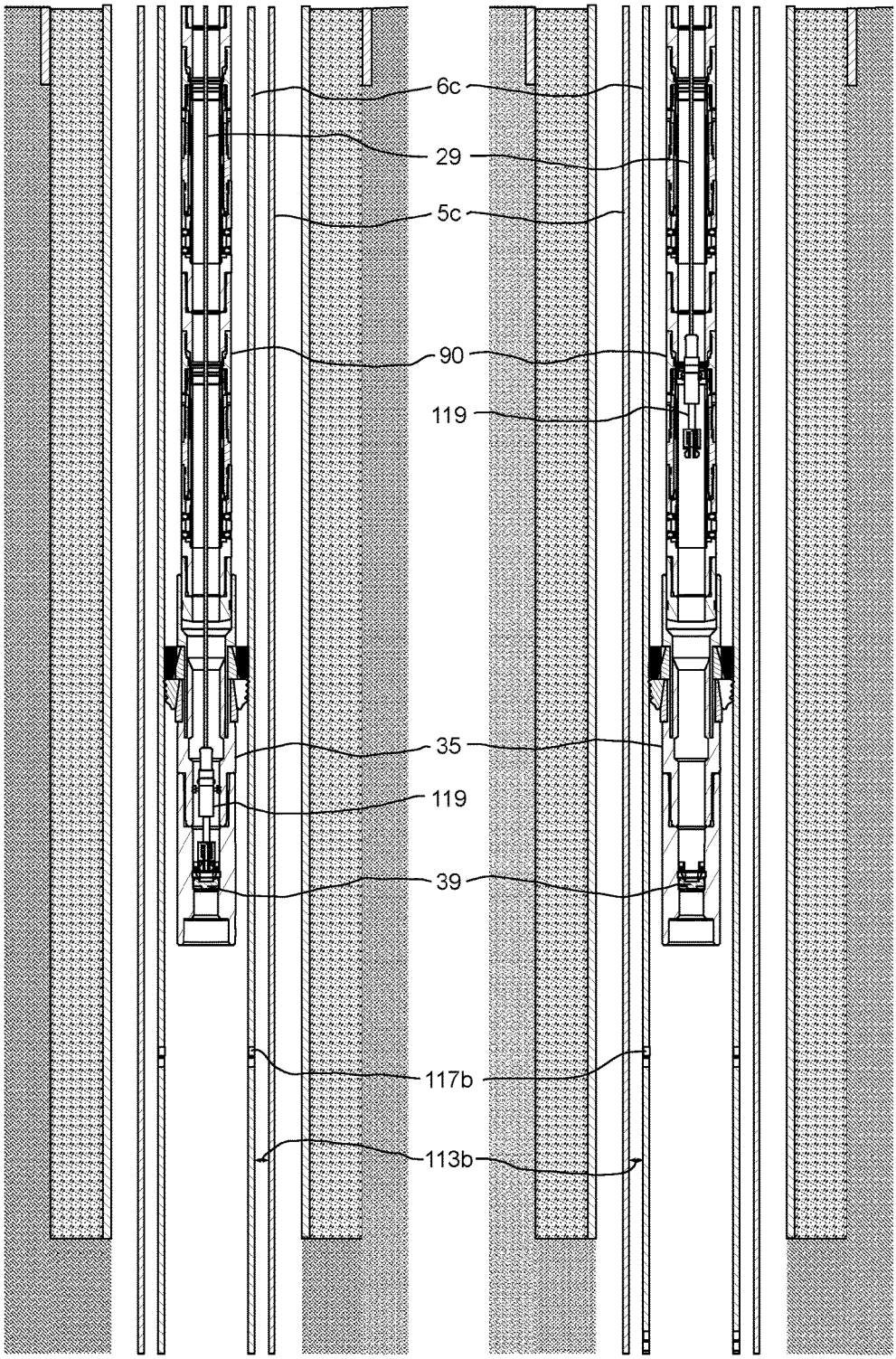
FIG. 6D illustrates setting of the bore plug in the lower annulus cementing tool.
FIG. 6E illustrates opening an isolation sleeve of the upper annulus cementing tool.
Figures 6F, 6G:
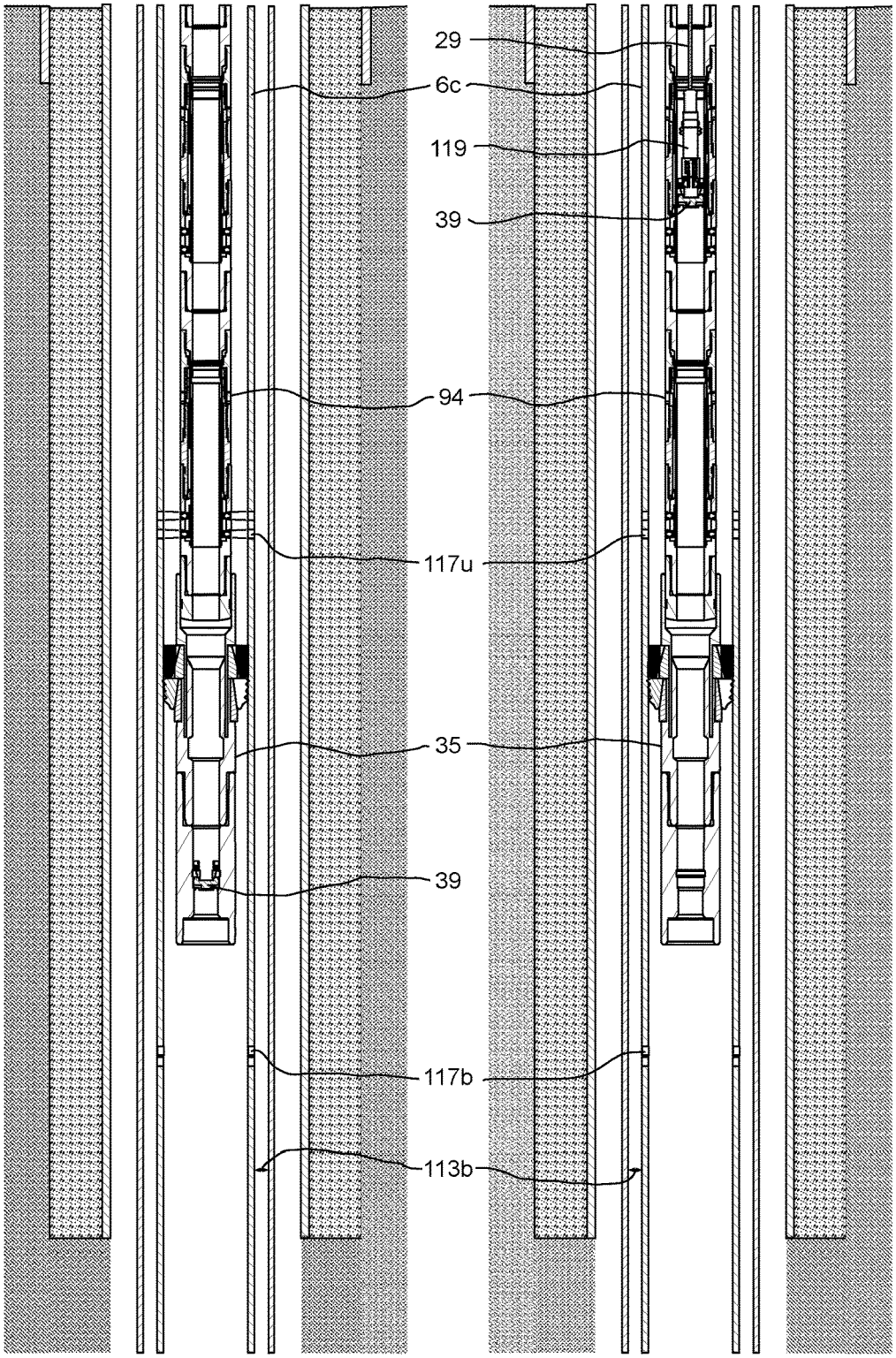
FIG. 6F illustrates firing of a perforating gun of the upper annulus cementing tool to again perforate the production casing.
FIG. 6G illustrates retrieval of the bore plug from the lower annulus cementing tool.

FIGS. 6A-6I illustrate sealing of an annulus 113*b* (aka the B annulus) formed between the production 6 and the intermediate 5 casing strings. FIG. 6A illustrates deployment of a lower perforating gun 114*b* of the annulus cementing system. Once the tool housing 112 has been installed onto the PCA 70, a seventh BHA 115*b* is assembled with a lubricator 116, connected to the wireline 29, and deployed to the PCA 70. The seventh BHA 115*b* includes a cablehead, a collar locator, and the perforating gun 114*b*. The cablehead, collar locator, and perforating gun 114*b* are connected together, such as by threaded connections or flanges and studs or bolts and nuts. The perforating gun includes a firing head and a charge carrier. The charge carrier includes a housing, a plurality of shaped charges, and a detonation cord connecting the charges to the firing head. The firing head receives electricity from the wireline 29 to operate an electric match thereof. The electric match (ignitor) ignites the detonation cord to fire the shaped charges.

The lubricator 116 includes an adapter, one or more stuffing boxes, a grease injector, a frame, a control relay, a tool catcher, a grease reservoir, and a grease pump. The adapter, stuffing boxes, grease injector, and tool catcher may each include a housing or body having a longitudinal bore therethrough and be connected, such as by flanges, such that a continuous bore is maintained therethrough.

The adapter includes a connector for mating with a connector profile of the tool housing 112, to thereby fasten the lubricator 116 to the tool housing 112. The connector is dogs or a collet. The adapter further includes a seal face or sleeve and a seal (not shown). The adapter further includes an actuator (not shown), such as a piston and a cam, for operating the connector. The adapter may further include an ROV interface so that the ROV 20 may connect to the connector, such as by a hot stab, and operate the connector actuator. The frame is fastened to the adapter and the relay is fastened to the frame. The grease pump and reservoir is also fastened to the frame.

Each stuffing box may include a seal, a piston, and a spring disposed in the housing. A port is formed through the housing in communication with the piston. The port is connected to the control relay via a hydraulic conduit (not shown). When operated by hydraulic fluid, the piston will longitudinally compress the seal, thereby radially expanding the seal inward into engagement with the wireline 29. The spring thus biases the piston away from the seal and be set to balance hydrostatic pressure.

The grease injector includes a housing integral with each stuffing box housing and one or more seal tubes. Each seal tube has an inner diameter slightly larger than an outer diameter of the wireline 29, thereby serving as a controlled gap seal. An inlet port and an outlet port is formed through the grease injector/stuffing box housing. A grease conduit (not shown) connects an outlet of the grease pump with the inlet port and another grease conduit (not shown) connects an inlet of the pump to the reservoir. The outlet port discharges into the sea 1 or a grease trap. The grease pump is electrically or hydraulically driven via cable/conduit (not shown) connected to the control relay and is operable to pump grease (not shown) from the grease reservoir into the inlet port and along the slight clearance formed between the seal tube and the wireline 29 to lubricate the wireline, reduce pressure load on the stuffing box seals, and increase service life of the stuffing box seals.

The tool catcher includes a piston, a latch, such as a collet, a stop, a piston spring, and a latch spring disposed in a housing thereof. The collet may have an inner cam surface for engagement with the cablehead and the catcher housing may have an inner cam surface for operation of the collet. The latch spring may bias the collet toward a latched position. The collet is movable from the latched position to an unlatched position by operation of the piston. The catcher housing has a hydraulic port formed through a wall thereof in fluid communication with the piston. A hydraulic conduit (not shown) connects the hydraulic port to the control relay. The piston is biased away from engagement with the collet by the piston spring. When operated, the piston engages the collet and moves the collet upward along the housing cam surface and into engagement with the stop, thereby moving the collet to the unlatched position.

FIG. 6B illustrates firing of the lower perforating gun 114*b* to perforate the production casing 6*c*. Once the lubricator 116 has landed onto the PCA 70, the ROV 20 operates the connector and installs a jumper (not shown) between the lubricator control relay and the PCA 70. The stuffing boxes and grease injector are activated and the tool catcher operated to release the seventh BHA 115*b*. The seventh BHA 115*b* is then lowered through the annulus cementing tools 35, 90 to a depth above the lower bridge plug 33*b*. Once the seventh BHA 115*b* has been deployed to the firing depth, electrical power is then supplied to via the wireline 29 to fire the perforating gun 114*b* into the production casing 6*c*, thereby forming lower perforations 117*b* through a wall thereof. The shaped charges of the perforating gun 114*b* may have a charge strength sufficient to form the lower perforations 117*b* through a wall of the production casing 6*c* without damaging a wall of the intermediate casing 5*c*, thereby providing access to the B annulus 113*b*. The seventh BHA 115*b* is then retrieved to the lubricator 116, the blind-shear BOP 74*b* closed, and the lubricator and seventh BHA 115*b* dispatched from the PCA 70 to the vessel 21.

FIG. 6C illustrates deployment of the bore plug 39. FIG. 6D illustrates setting of the bore plug 39 in the lower annulus cementing tool 35. FIG. 6E illustrates opening an isolation sleeve 109 of the upper annulus cementing tool 90. Once the lower perforations 117*b* have been formed, an eighth BHA 118 is assembled with the lubricator 116 and connected to the wireline 29 and deployed through the open sea 1 to the tool housing 112. The eighth BHA 118 includes a cablehead, a collar locator, a shifting tool 119, and the bore plug 39. The shifting tool 119 is similar to the setting tool 65 with the addition of a shifter. The shifter may include two or more radial piston and cylinder assemblies and a latch connected to each piston for engagement with the isolation sleeve 109.

Once the lubricator 116 has landed onto the PCA 70, the ROV 20 operates the connector and installs the jumper. The stuffing boxes and grease injector are activated and then the blind-shear BOP 74*b* opened. The tool catcher is operated to release the eighth BHA 118 and the eighth BHA 118 is then lowered through the upper annulus cementing tool 90 and into the lower annulus cementing tool 35 to a depth adjacent the nipple 38. The shifting tool 119 is then operated via the wireline 29 to install the bore plug 39 into the nipple profile. The shifting tool 119 is then operated via the wireline 29 to release the bore plug 39 and the eighth BHA 118 (minus the bore plug) raised into the upper annulus cementing tool 90 until the shifter is adjacent to the isolation sleeve 109 of the perforating gun 94. The shifting tool 119 is operated via the wireline 29 to engage the isolation sleeve 109 and shift the isolation sleeve to the armed position. The eighth BHA 118 (minus the bore plug 39) is then retrieved to the lubricator 116 and the blind-shear BOP 74*b* closed.

FIG. 6F illustrates firing of the perforating gun 94 of the upper annulus cementing tool 90 to again perforate the production casing 6*c*. Once the perforation gun 94 has been armed, conditioner 120 (FIG. 7D) is pumped from the vessel 21, down the supply fluid conduit 88*n*, through the conduit 81*n* and fluid sub port 73*p*, through a bore of the PCA 70, through the bore of the upper annulus cementing tool 90, and against the seated bore plug 39, thereby increasing pressure in the bores of the annulus cementing tools 35, 90 until the firing differential is achieved, thereby firing the perforating gun 94 into the production casing 6*c* and forming upper perforations 117*u* through the wall thereof. The shaped charges 103 of the perforating gun 94 have a charge strength sufficient to form the upper perforations 117*u* through a wall of the production casing 6*c* without damaging a wall of the intermediate casing 5*c*, thereby providing further access to the B annulus 113*b*.

FIG. 6G illustrates retrieval of the bore plug 39 from the lower annulus cementing tool 35. Once the upper perforations 117*u* have been formed, the blind-shear BOP 74*b* is opened and the eighth BHA 118 (minus the bore plug 39) is then lowered through the upper annulus cementing tool 90 and into the lower annulus cementing tool 35 to a depth adjacent the nipple 38. The shifting tool 119 is then operated via the wireline 29 to engage the bore plug 39 and remove the bore plug from the nipple profile. The eighth BHA 118 is then retrieved to the lubricator 116, the blind-shear BOP 74*b* closed, and the lubricator and eighth BHA dispatched from the PCA 70 to the vessel 21.

Figure 7A:
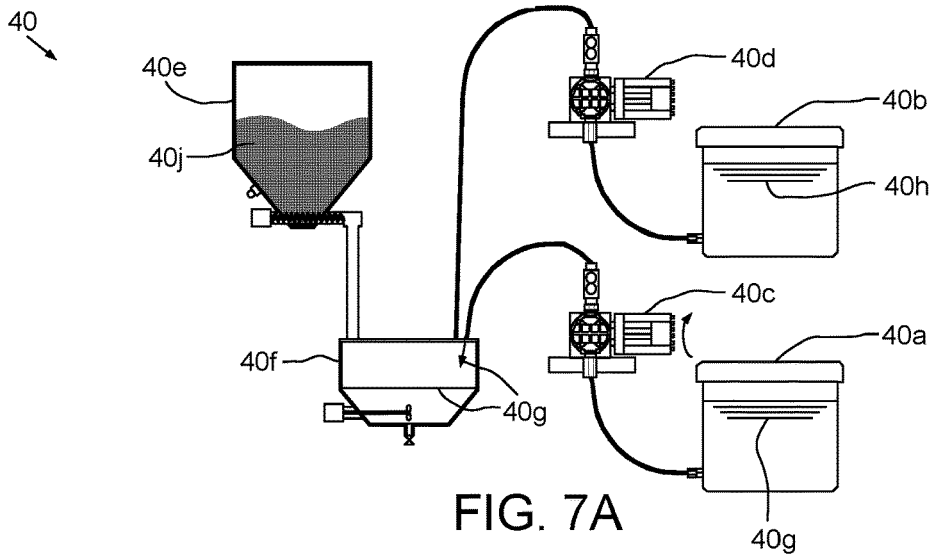
FIGS. 7A-7C illustrate operation of a mixing unit to form sealant.
Figure 7B:
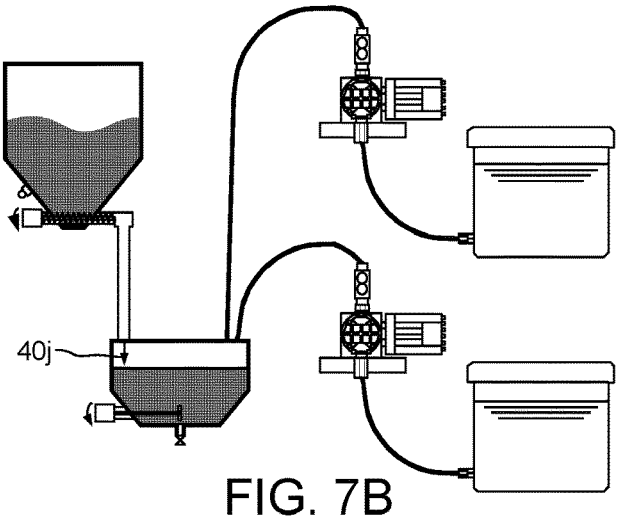
Figure 7C:
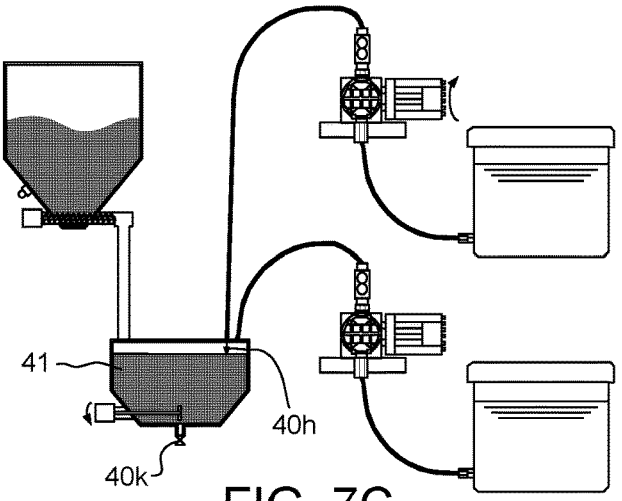

FIGS. 7A-7C illustrate operation of the mixing unit 40 to form sealant 41. The mixing unit 40 may include two or more liquid totes 40*a,b*, a transfer pump 40*c,d* for each liquid tote, a dispensing hopper 40*e*, and a blender 40*f*. Each transfer pump 40*c,d* is a metering pump and the dispensing hopper 40*e* is a metering hopper. An inlet of each transfer pump 40*c,d* is connected to the respective liquid tote 40*a,b*.

A first 40*a* of the liquid totes 40*a,b* includes a resin 40*g*. The resin 40*g* is an epoxide, such as bisphenol F. The viscosity of the sealant 41 is adjusted by premixing the resin 40*g* with a diluent, such as alkyl glycidyl ether or benzyl alcohol. The viscosity of the sealant 41 may range between one hundred and two thousand centipoise. The epoxide is also premixed with a bonding agent, such as silane. A second 40*b* of the liquid totes 40*a,b* includes a hardener 40*h* selected based on the temperature in the wellbore 2. For low temperature, the hardener 40*h* is an aliphatic amine or polyamine or a cycloaliphatic amine or polyamine, such as tetraethylenepentamine. For high temperature, the hardener 40*h* is an aromatic amine or polyamine, such as diethyltoluenediamine. The dispensing hopper 40*e* includes a particulate weighting material 40*j* having a specific gravity of at least two. The weighting material 40*j* is barite, hematite, hausmannite ore, or sand.

Alternatively, wellbore fluid is non-aqueous and the resin 40*g* is also premixed with a surfactant to maintain cohesion thereof. Alternatively, the resin 40*g* is also premixed with a defoamer.

To form the sealant 41, the first transfer pump 40*c* is operated to dispense the resin 40*g* into the blender 40*f*. A motor of the blender 40*f* is then activated to churn the resin 40*g*. The hopper 40*e* is then operated to dispense the weighting material 40*j* into the blender 40*f*. The weighting material 40*j* is added in a proportionate quantity such that a density of the sealant 41 corresponds to a density of the wellbore fluid. The density of the sealant 41 is equal to, slightly greater than, or slightly less than the density of the wellbore fluid.

The second transfer pump 40*b* is operated to dispense the hardener 40*h* into the blender 40*f*. The hardener 40*h* is added in a proportionate quantity such that a thickening time of the sealant 41 corresponds to a time required to pump the sealant through the supply fluid conduit 88*n* and into the B annulus 113*b* plus a safety factor, such as one hour. Once the blender 40*f* has formed the sealant 41 into a homogenous mixture, a supply valve 40*k* connected to an outlet of the blender is opened.

Figures 7D, 7E:
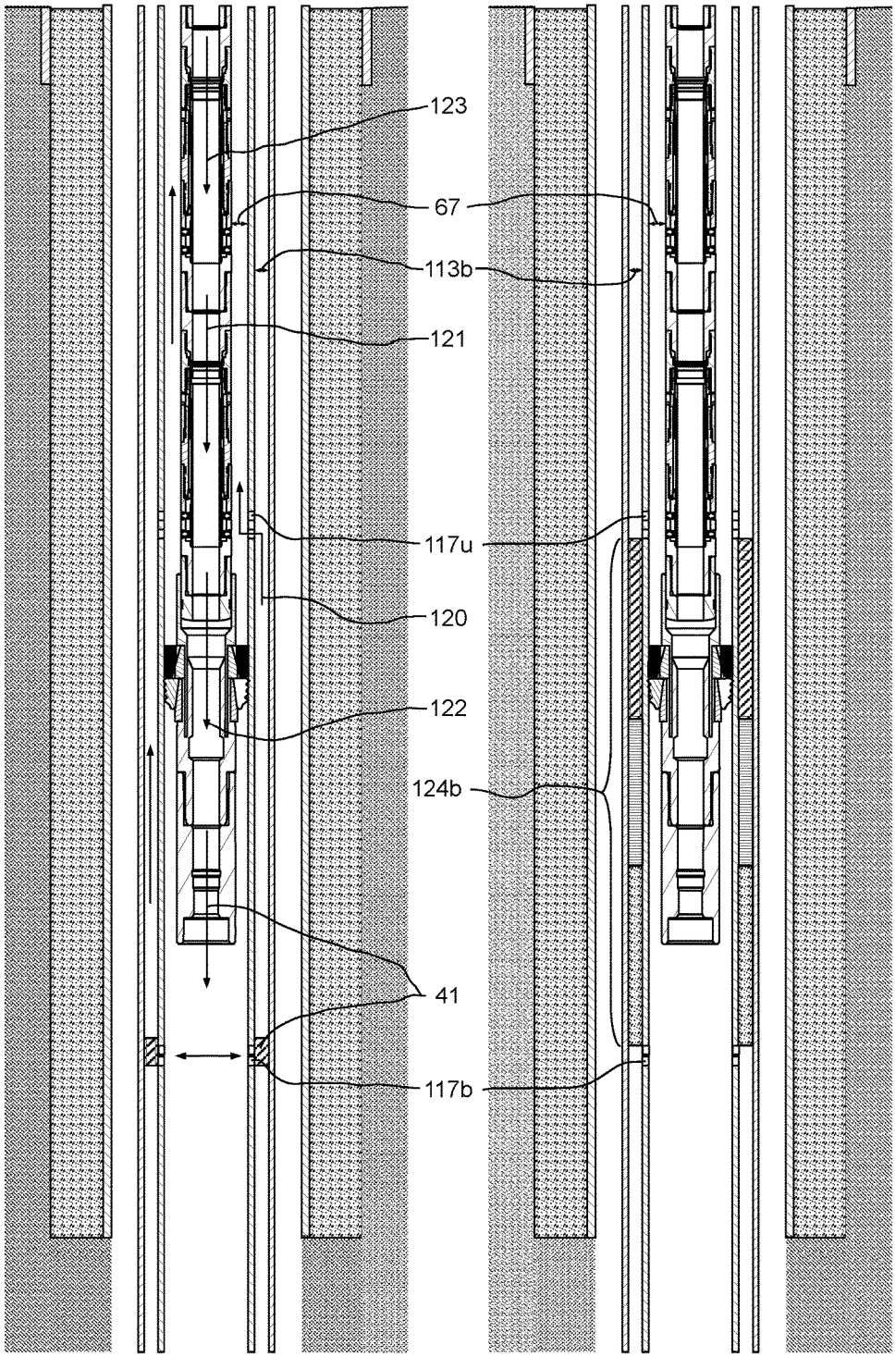

FIG. 7D illustrates pumping cement slurry 121 and the sealant 41 into the B annulus 113*b*. FIG. 7E illustrates a cured sheath 124*b* of cement and sealant in the B annulus 113*b*. The sealant 41 is then pumped into the supply fluid conduit 88*n* as a first component of a fluid train. Spacer fluid 122 is then pumped into the supply fluid conduit 88*n* behind the sealant 41 as a second component of the fluid train. The cement slurry 121, such as Portland cement slurry, is then pumped into the supply fluid conduit 88*n* behind the spacer fluid 122 as a third component of the fluid train. The spacer fluid 122 prevents mixing of the sealant 41 with the cement slurry 121 and is a non-setting liquid compatible with the sealant.

The fluid train is driven through the supply fluid conduit 81*n* by chaser fluid 123. The fluid train continues through the conduit 81*n* and fluid sub port 73*p*, through a bore of the PCA 70, and through the bore of the upper annulus cementing tool 90. The fluid train flows through the bore of the lower annulus cementing tool 35 and exits into the bore of the production casing 6. Continued pumping of the chaser fluid 123 drives the fluid train into the B annulus 113*b* via the lower perforations 117*b*. The displaced conditioner 120 flows from the B annulus 113*b* into the working annulus 67 via the upper perforations 117*u*. The displaced conditioner 120 may continue up the working annulus 67, through the subsea wellhead 10, and into the return fluid conduit 88*o* via the fluid passage 72*p* and conduit 81*o*. The displaced conditioner 120 may continue up the return fluid conduit 88*o* to the vessel 21.

Pumping of the chaser fluid 123 is halted once the fluid train has been pumped into the B annulus 113*b*. Densities of the conditioner 121 and fluid train correspond so that the fluid train in the B annulus 113*b* is in a balanced condition. The sealant 41 and cement slurry 121 in the B annulus 113*b* is then allowed to cure, thereby forming respective B annulus composite sheath 124*b*.

Figure 8A:
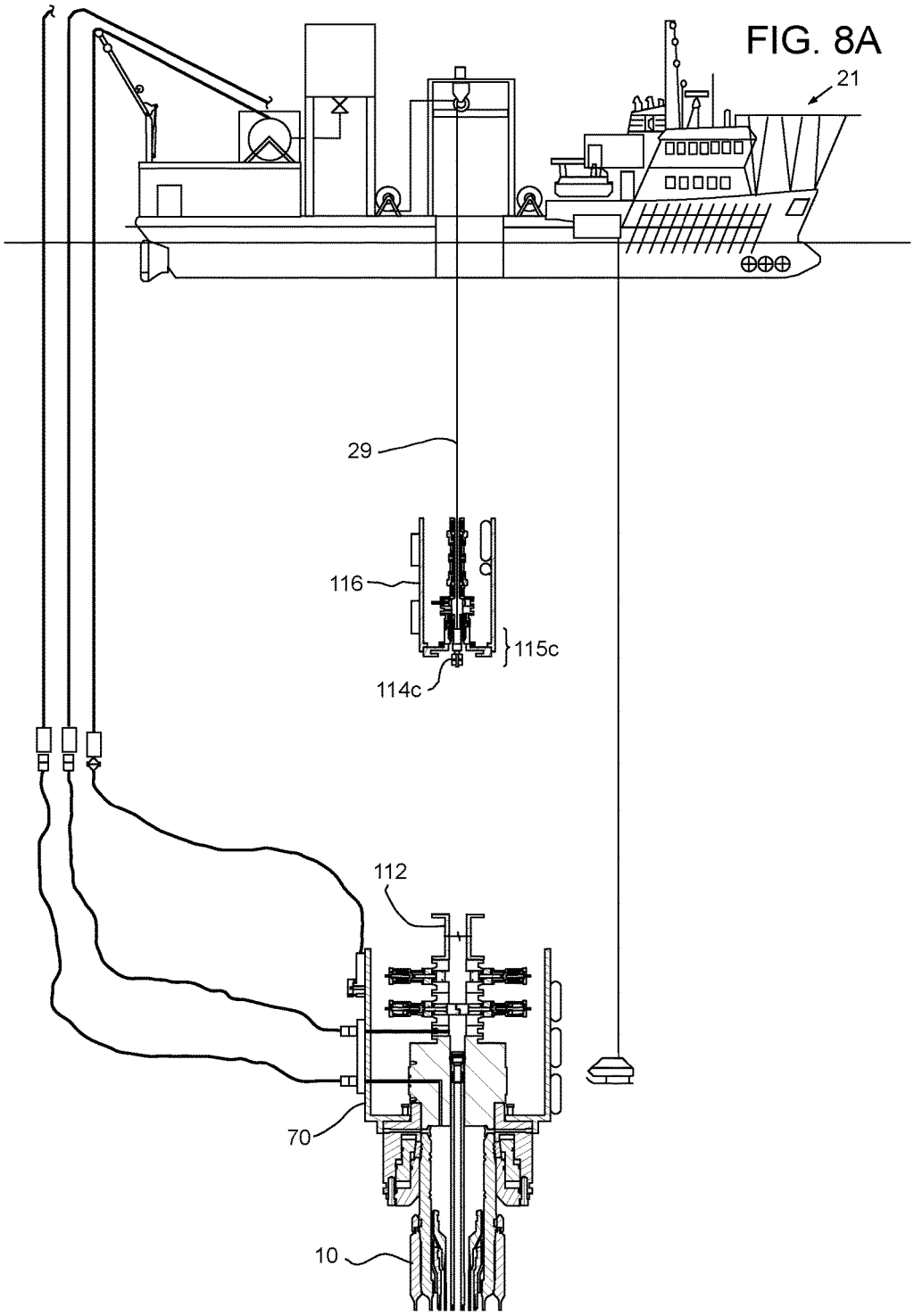
FIGS. 8A-8I illustrate sealing of an annulus formed between the intermediate and the surface casing strings.
Figures 8B, 8D:
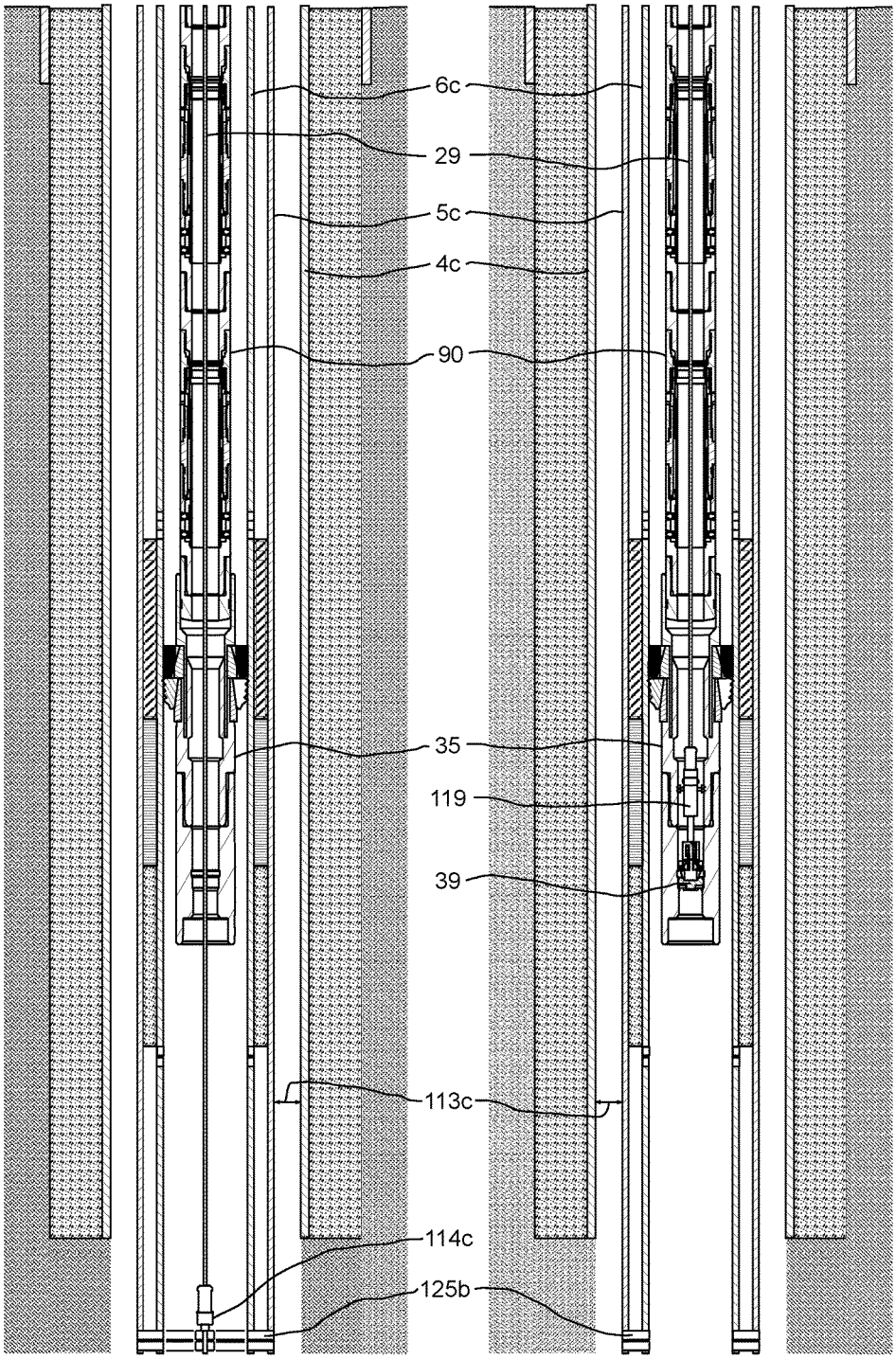
Figure 8C:
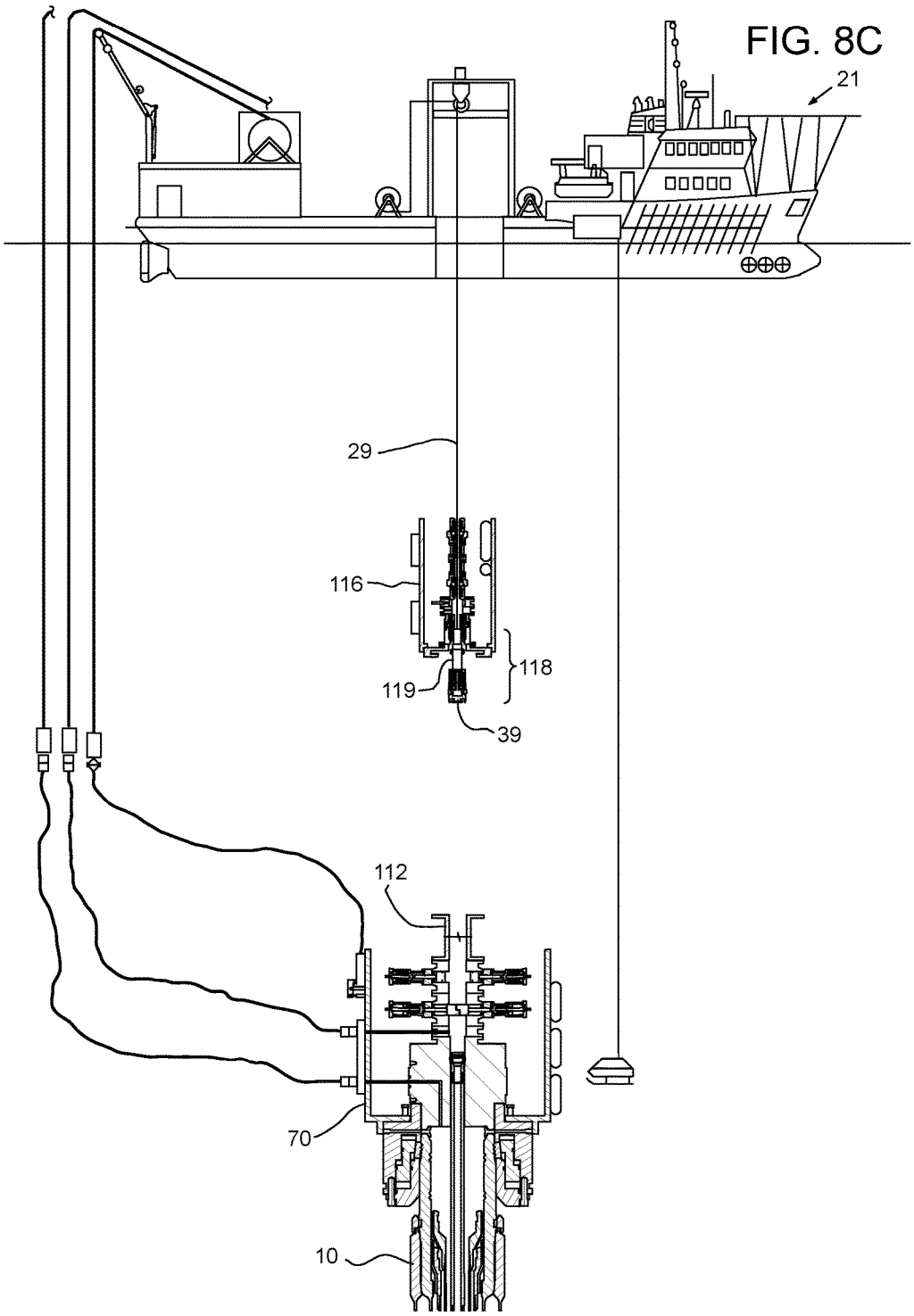
Figures 8E, 8F:
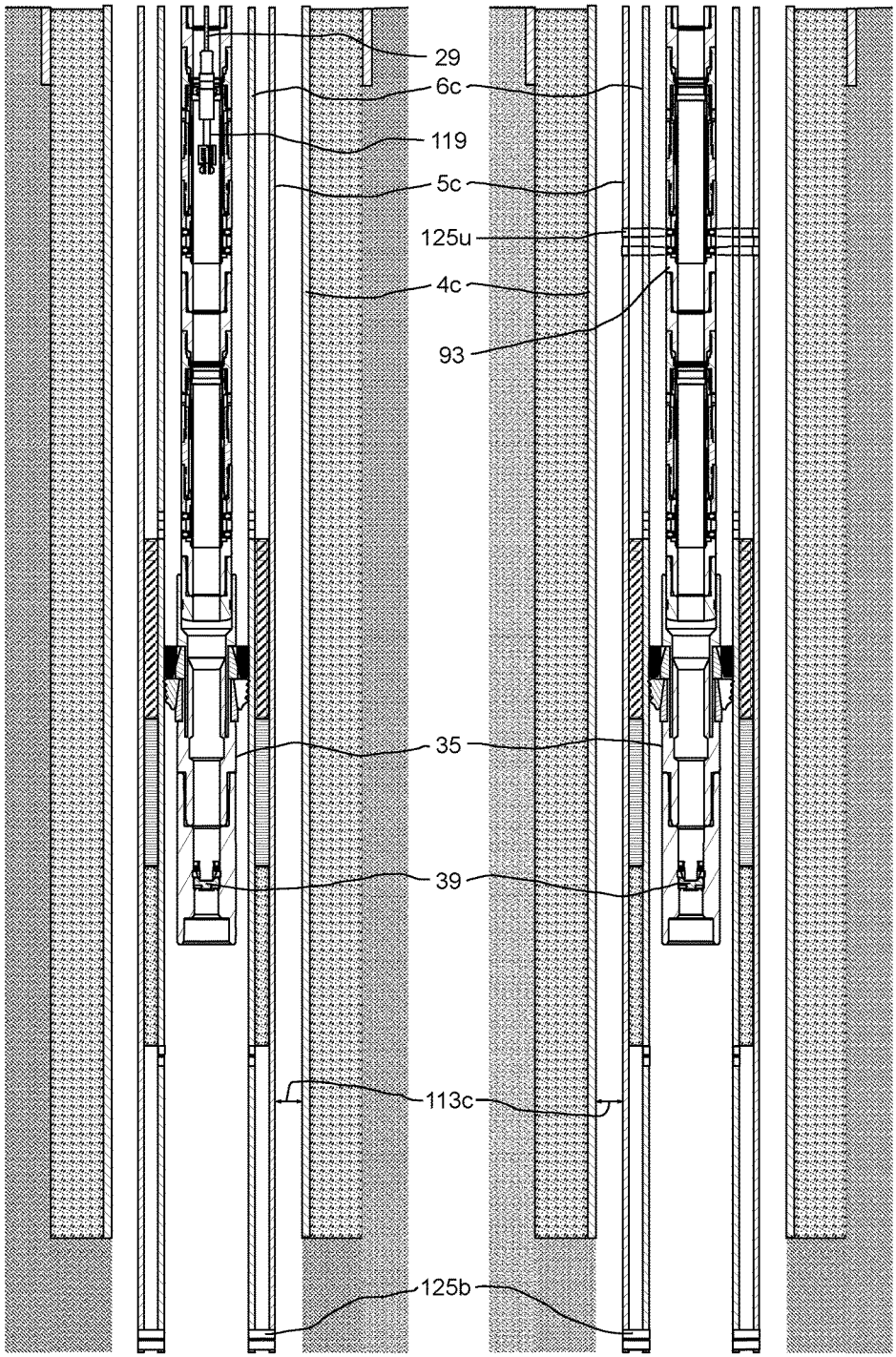

FIGS. 8A-8I illustrate sealing of an annulus 113*c* (aka the C annulus) formed between the intermediate casing 5 and the surface 4 casing strings. FIG. 8A illustrates deployment of a second lower perforating gun 114*c* of the annulus cementing system. Once the B annulus composite sheath 124*b* has formed, a ninth BHA 115*c* is assembled with the lubricator 116, connected to the wireline 29, and deployed to the PCA 70. The ninth BHA 115*c* is similar to the seventh BHA 115*b* except for having a perforating gun 114*c* instead of the perforating gun 114*b*.

FIG. 8B illustrates firing of the lower perforating gun 114*c* to perforate the production 6 and intermediate 5 casing strings. Once the lubricator 116 has landed onto the PCA 70, the ROV 20 operates the connector and install the jumper between the lubricator control relay and the PCA 70. The stuffing boxes and grease injector are activated, the blind-shear ram BOP 74*b* opened, and the tool catcher is operated to release the ninth BHA 115*c*. The ninth BHA 115*c* is then lowered through the annulus cementing tools 35, 90 to a depth below the lower perforations 117*b*. Once the ninth BHA 115*c* has been deployed to the firing depth, electrical power is then supplied to via the wireline 29 to fire the perforating gun 114*c* through the production casing 6*c* and through a wall of the intermediate casing 5*c*, thereby forming lower perforations 125*b*. The perforating gun 114*c* is similar to the perforating gun 114*b* except for having shaped charges with a charge strength sufficient to form the lower perforations 125*b* through the wall of the production 5*c* and intermediate 6*c* casings without damaging a wall of the surface casing 4*c*, thereby providing access to the C annulus 113*c*. The ninth BHA 115*c* is then retrieved to the lubricator 116, the blind-shear BOP 74*b* closed, and the lubricator and seventh BHA 115*b* dispatched from the PCA 70 to the vessel 21.

FIG. 8C illustrates redeployment of the bore plug 39. FIG. 8D illustrates again setting the bore plug 39 in the lower annulus cementing tool 35. FIG. 8E illustrates opening a second isolation sleeve 109 of the upper annulus cementing tool 90. Once the lower perforations 125*b* have been formed, the eighth BHA 118 is assembled with the lubricator 116 and connected to the wireline 29 and deployed through the open sea 1 to the tool housing 112. Once the lubricator 116 has landed onto the PCA 70, the ROV 20 may operate the connector and install the jumper. The stuffing boxes and grease injector are activated and then the blind-shear BOP 74*b* opened. The tool catcher is operated to release the eighth BHA 118 and the eighth BHA 118 is then lowered through the upper annulus cementing tool 90 and into the lower annulus cementing tool 35 to a depth adjacent the nipple 38. The shifting tool 119 is then operated via the wireline 29 to install the bore plug 39 into the nipple profile. The shifting tool 119 is then operated via the wireline 29 to release the bore plug 39 and the eighth BHA 118 (minus the bore plug) raised into the upper annulus cementing tool 90 until the shifter is adjacent to the isolation sleeve 109 of the perforating gun 93. The shifting tool 119 is operated via the wireline 29 to engage the isolation sleeve 109 and shift the isolation sleeve to the armed position. The eighth BHA 118 (minus the bore plug 39) is then retrieved to the lubricator 116 and the blind-shear BOP 74*b* closed.

FIG. 8F illustrates firing of a second perforating gun 93 of the upper annulus cementing tool 90 to again perforate the production 6 and intermediate 5 casing strings. Once the perforation gun 93 has been armed, the conditioner 120 is pumped from the vessel 21, down the supply fluid conduit 88*n*, through the conduit 81*n* and fluid sub port 73*p*, through a bore of the PCA 70, through the bore of the upper annulus cementing tool 90, and against the seated bore plug 39, thereby increasing pressure in the bores of the annulus cementing tools 35, 90 until the firing differential is achieved, thereby firing the perforating gun 93 through the production casing 6*c* and through the wall of the intermediate casing 5*c*, thereby forming upper perforations 125*u* through the wall thereof. The shaped charges 103 of the perforating gun 93 have a charge strength sufficient to form the upper perforations 125*u* through the walls of the production 5*c* and intermediate 6*c* casings without damaging a wall of the surface casing 4*c*, thereby providing further access to the C annulus 113*c*.

Figures 8G, 8H:
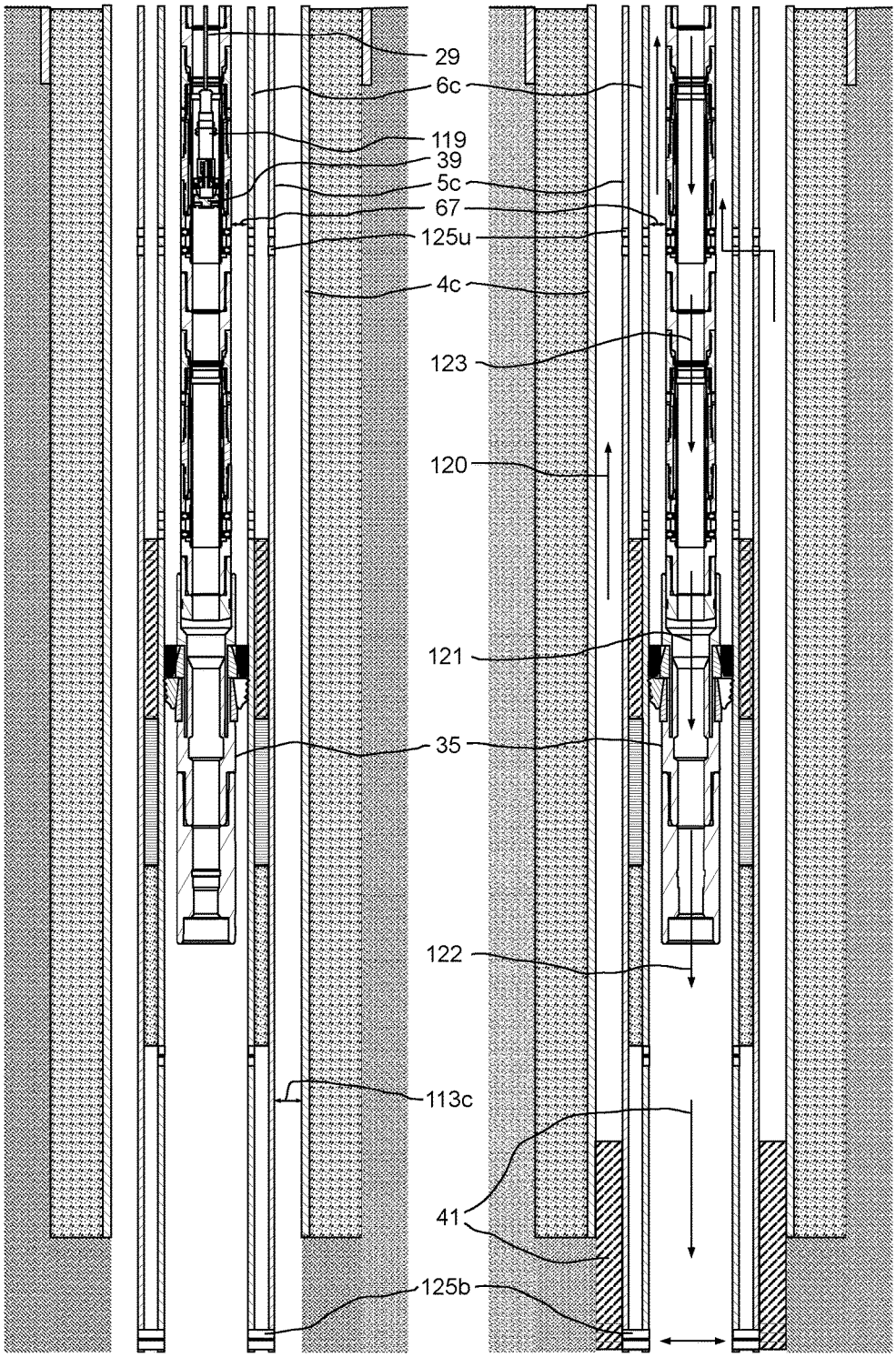

FIG. 8G illustrates repeat retrieval of the bore plug 39 from the lower annulus cementing tool 35. Once the upper perforations 125*u* have been formed, the blind-shear BOP 74*b* is opened and the eighth BHA 118 (minus the bore plug 39) is then lowered through the upper annulus cementing tool 90 and into the lower annulus cementing tool 35 to a depth adjacent the nipple 38. The shifting tool 119 is then operated via the wireline 29 to engage the bore plug 39 and remove the bore plug from the nipple profile. The eighth BHA 118 is then retrieved to the lubricator 116, and the blind-shear BOP 74*b* closed.

FIG. 8H illustrates pumping the cement slurry 121 and the sealant 41 into the C annulus 113*c*. Another batch of the sealant 41 may then pumped into the supply fluid conduit 88*n* as a first component of a second fluid train. Spacer fluid 122 may then pumped into the supply fluid conduit 88*n* behind the sealant 41 as a second component of the second fluid train. The cement slurry 121 is then pumped into the supply fluid conduit 88*n* behind the spacer fluid 122 as a third component of the second fluid train. The second fluid train is driven through the supply fluid conduit 81*n* by the chaser fluid 123. The second fluid train continues through the conduit 81*n* and fluid sub port 73*p*, through a bore of the PCA 70, and through the bore of the upper annulus cementing tool 90. The second fluid train continues into the C annulus 113*c* via the lower perforations 125*b*. The displaced conditioner 120 flows from the C annulus 113*c* into the working annulus 67 via the upper perforations 125*u*. The displaced conditioner 120 then continues up the working annulus 67, through the subsea wellhead 10, and into the return fluid conduit 88*o* via the fluid passage 72*p* and conduit 81*o*. The displaced conditioner 120 continue to flow up the return fluid conduit 88*o* to the vessel 21. Pumping of the chaser fluid 123 is halted once the second fluid train has been pumped into the C annulus 113*c*. Densities of the conditioner 121 and second fluid train may correspond so that the cement slurry 121 in the C annulus 113*c* is in a balanced condition. The cement slurry 121 in the C annulus 113*c* is then allowed to cure, thereby forming the C annulus composite sheath 124*c* (FIG. 8I).

Figure 8I:
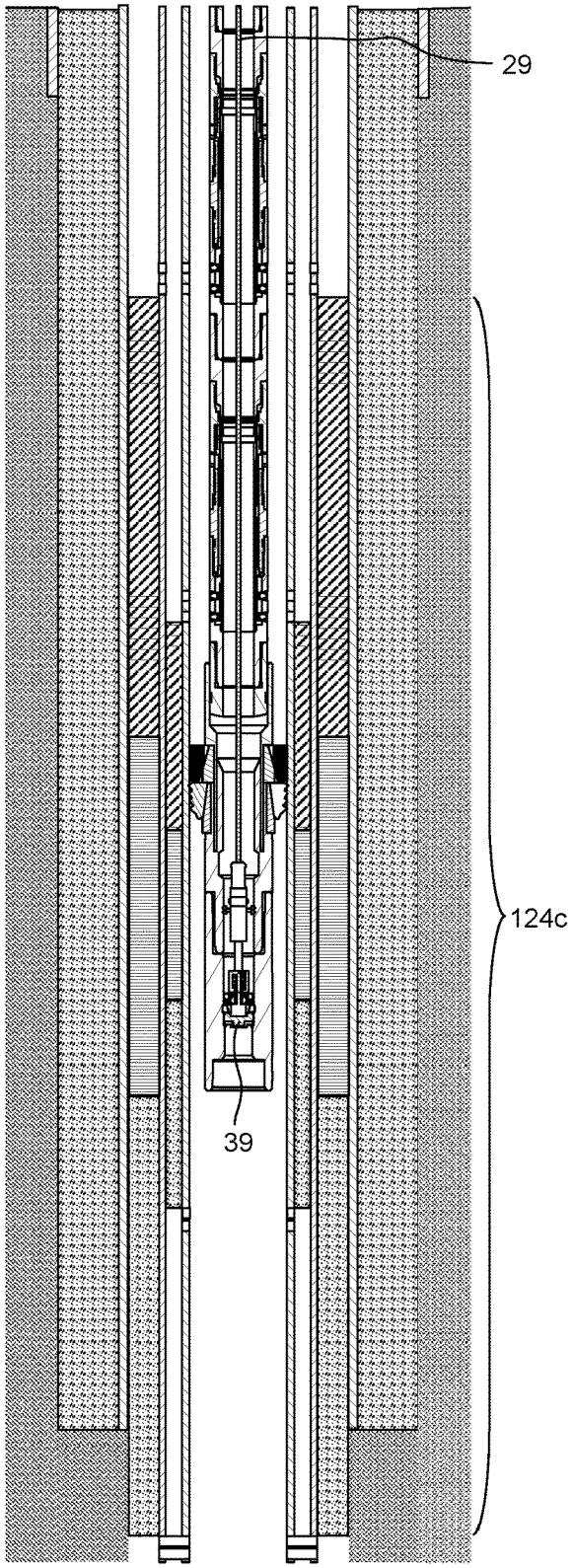

FIG. 8I illustrates the cured composite sheath 124*c* formed in the C annulus 113*c* and again setting the bore plug 39 in the lower annulus cementing tool 35. Once the C annulus composite sheath 124*c* has formed, the blind-shear BOP 74*b* is opened and the eighth BHA 118 (minus the bore plug 39) is then lowered through the upper annulus cementing tool 90 and into the lower annulus cementing tool 35 to a depth adjacent the nipple 38. The shifting tool 119 is then operated via the wireline 29 to install the bore plug 39 into the nipple profile. The eighth BHA 118 (minus the bore plug 39) is then retrieved to the lubricator 116 and the lubricator and eighth BHA dispatched from the PCA 70 to the vessel 21.

Figure 9A:
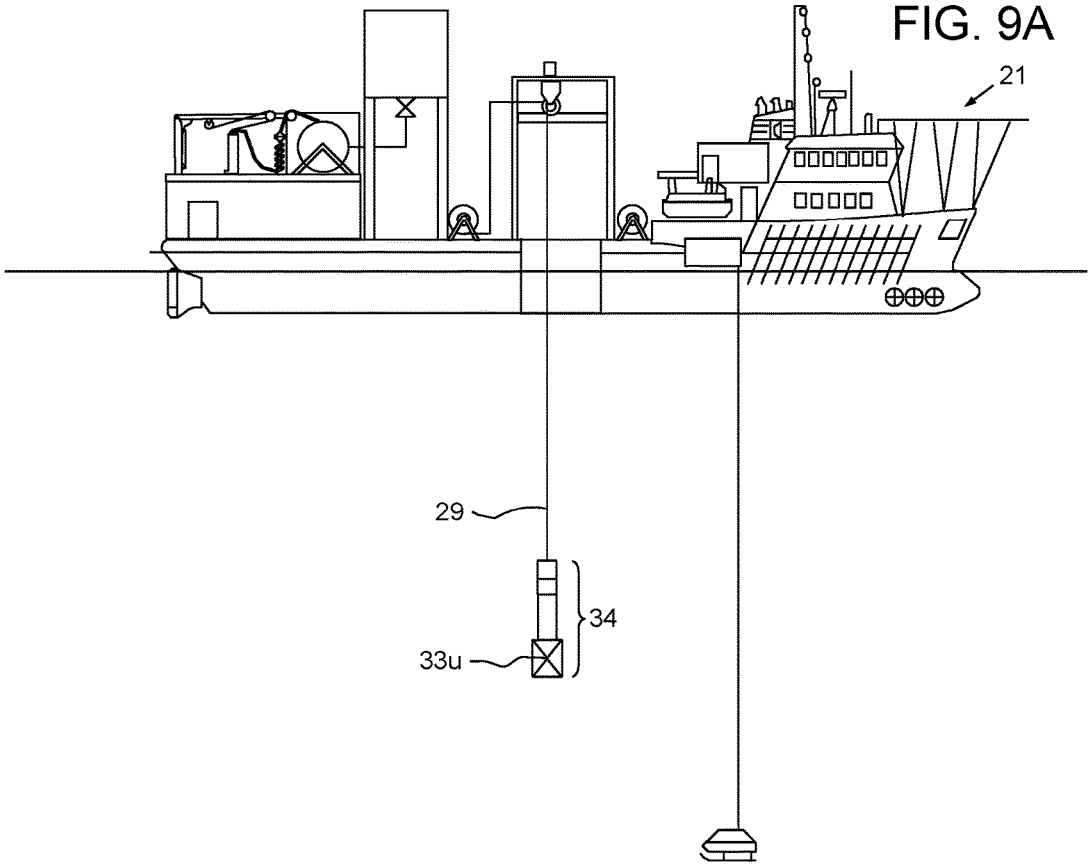
FIGS. 9A-9C illustrate abandonment of the subsea wellhead.
Figure 9A:
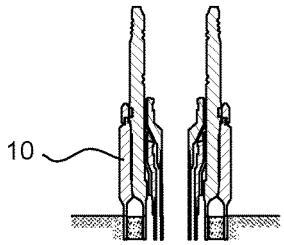
Figure 9B:
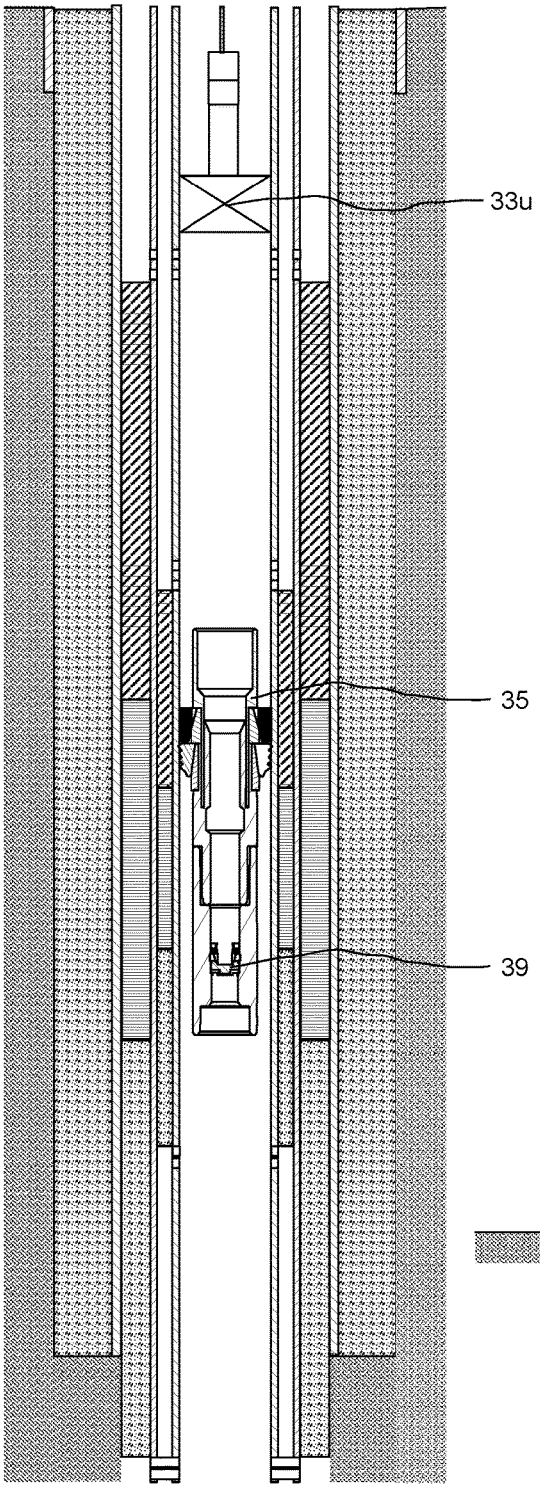
Figure 9C:
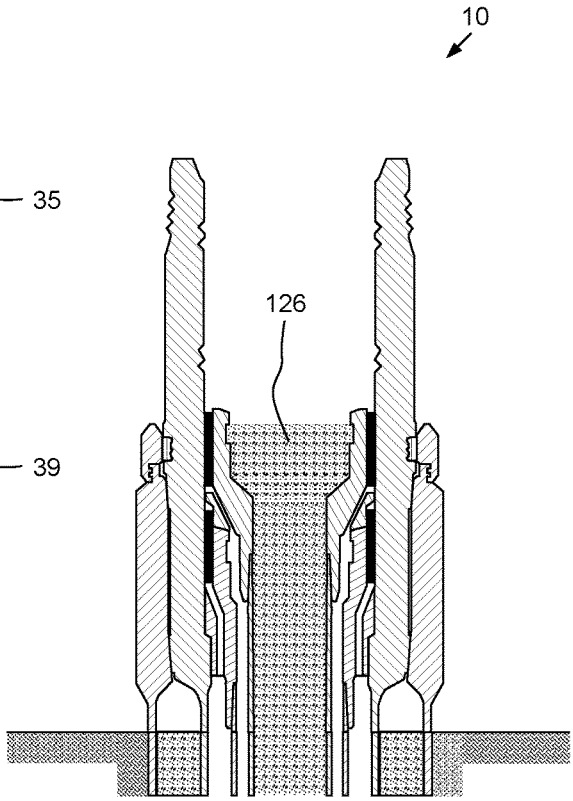

FIGS. 9A-9C illustrate abandonment of the subsea wellhead 10. Once the bore plug 39 has been reinstalled, the grapple 69 is connected to the wire rope 25 and deployed through the open sea 1 to the tool housing 112. The ROV 20 guides landing of the grapple 69 onto the tool housing 112. The ROV 20 then operates the grapple 69 to engage the tool housing 112. The grapple 69 and engaged tool housing 112 are dispatched from the PCA 70 to the vessel 21. The dry break connections 83*n, o* and the termination head 84*h* are released from the PCA 70 and the fluid conduits 88*n,o* and the control line 84*u* retrieved to the vessel 21. The grapple 69 is redeployed through the open sea 1 to the PCA 70. The ROV 20 then operates the grapple 69 to engage the PCA 70 and operate the wellhead connector 71 to disengage the wellhead 10. The grapple 69 and engaged tool housing 112 are dispatched from the wellhead 10 to the vessel 21.

FIG. 9A illustrates deployment of an upper bridge plug 33*u*. FIG. 9B illustrates setting the upper bride plug 33*u* in the production casing 6*c*. Once the PCA 70 has been retrieved to the vessel 21, the fourth BHA 34 (with the upper bridge plug 33*u*) is connected to the wireline 29 and deployed through the open sea 1 to the subsea wellhead 10. The fourth BHA 34 is lowered through the subsea wellhead 10 into the production casing 6*c* and deployed to a depth therein above the upper C annulus perforations 125*u*. Once the fourth BHA 34 has been deployed to the setting depth, electrical power is then supplied to the fourth BHA via the wireline 29 to operate the setting tool, thereby expanding the upper bridge plug 33*u* against the inner surface of the production casing 6*c*. Once the upper bridge plug 33*u* has been set, the plug is released from the setting tool by exerting tension on (pulling on) the wireline 29 to fracture the shearable fastener. The fourth BHA 34 (minus the upper bridge plug 33*u*) is then retrieved to the vessel 21.

FIG. 9C illustrates cement plugging a bore of the production casing 6*c*. Once the upper bridge plug 33*u* has been set, cement slurry is pumped into the production casing bore down to the upper bridge plug 33*u* and allowed to cure, thereby forming a top cement plug 126. The wellhead 10 is then left utilizing the casing packoffs as additional barriers.

Figure 10:
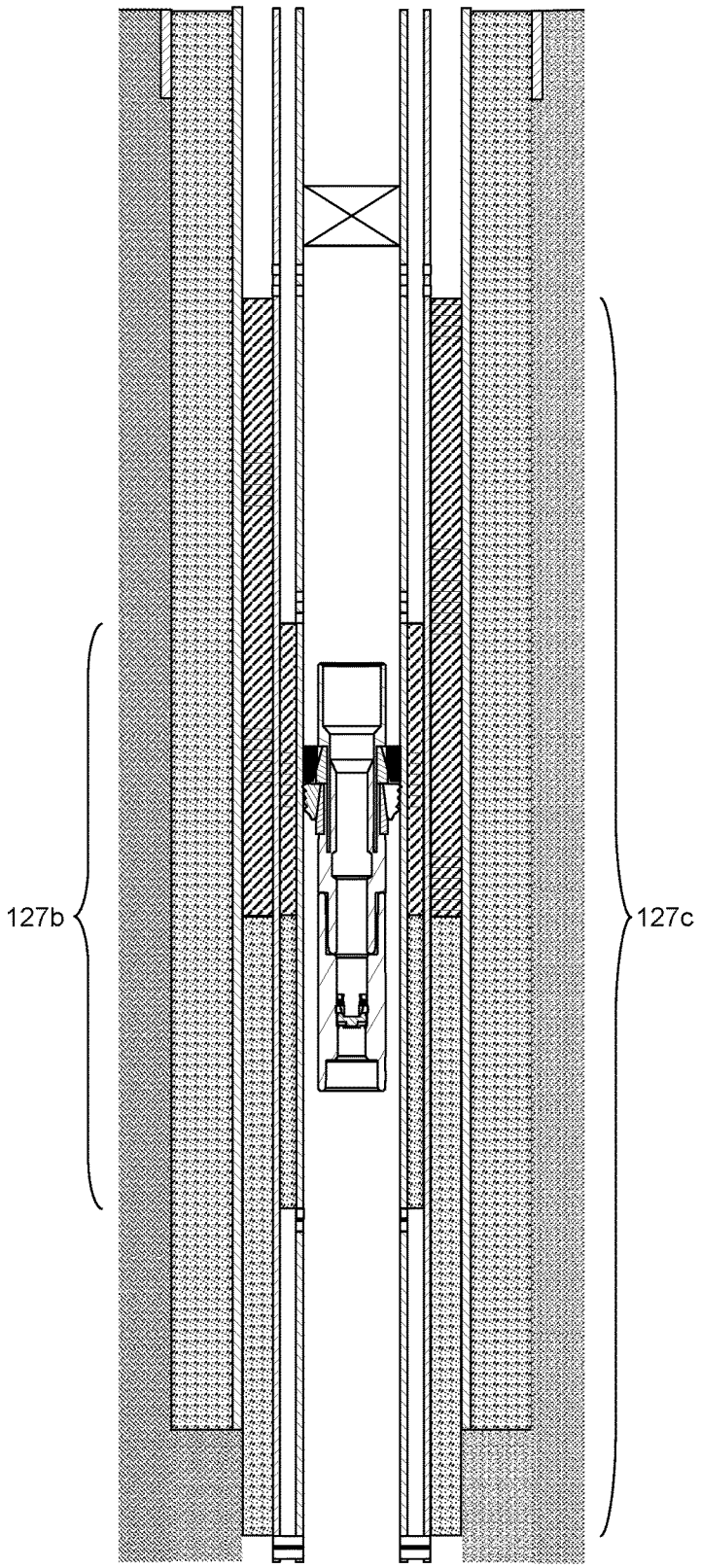
FIG. 10 illustrates alternative cured sheaths in the respective annuli, according to another embodiment of the present disclosure.

FIG. 10 illustrates alternative cured sheaths 127*b,c* n the respective annuli 113*b,c*, according to another embodiment of the present disclosure. Alternatively, the spacer fluid 122 is omitted from the fluid trains such that each fluid train includes the sealant 41 followed directly by the cement slurry 121.

While the foregoing is directed to embodiments of the present disclosure, other and further embodiments of the disclosure is devised without departing from the basic scope thereof, and the scope of the invention is determined by the claims that follow.

The invention claimed is:

1. A method for abandonment of a subsea well, comprising:

deploying a lower cementing tool through open sea to a subsea wellhead;

setting a packer of the lower cementing tool against a bore of an inner casing hung from the subsea wellhead;

fastening a pressure control assembly (PCA) to the subsea wellhead after deploying the lower cementing tool through the open sea to the subsea wellhead;

hanging an upper cementing tool from the PCA and stabbing the upper cementing tool into a polished bore receptacle of the lower cementing tool;

perforating a wall of the inner casing below the packer;

perforating the inner casing wall above the packer by operating a perforator of the upper cementing tool;

mixing a resin and a hardener to form a sealant;

pumping a fluid train through bores of the upper and lower cementing tools and into an inner annulus formed between the inner casing and an outer casing hung from the subsea wellhead, wherein the fluid train comprises the sealant followed by a cement slurry; and wherein the fluid train further comprises a spacer fluid disposed between the sealant and the cement slurry, wherein the spacer fluid comprises a non-setting liquid.

2. The method of claim 1, further comprising:

perforating walls of the inner and outer casings below the packer;

perforating the inner and outer casing walls above the packer by operating a second perforator of the upper cementing tool;

pumping a second fluid train through bores of the cementing tools and into an outer annulus formed between the outer casing and a third casing hung from the subsea wellhead, wherein the second fluid train comprises the sealant followed by cement slurry.

3. The method of claim 2, wherein the second fluid train further comprises a spacer fluid disposed between the sealant and the cement slurry.

4. The method of claim 1, wherein:

the resin is bisphenol F epoxide, the hardener is selected from a group consisting of tetraethylenepentamine for a low temperature well and diethyltoluenediamine for a high temperature well, and the resin is premixed with a diluent selected from a group consisting of alkyl glycidyl ether and benzyl alcohol.

5. The method of claim 1, wherein a density of the sealant corresponds to a density of fluid present in the well.

6. The method of claim 1, wherein a viscosity of the sealant is between 100-2,000 cp.

7. The method of claim 1, wherein:

a weighting material is also mixed with the resin and the hardener, and the weighting material has a specific gravity of at least 2.

8. The method of claim 7, wherein the weighting material is selected from a group consisting of: barite, hematite, hausmannite ore, and sand.

9. The method of claim 1, wherein:

the resin is premixed with a bonding agent, and the bonding agent is silane.

10. The method of claim 1, wherein the cement slurry is Portland cement slurry.

11. The method of claim 1, further comprising setting a bridge plug in the inner casing bore before setting the packer.

12. The method of claim 1, wherein the method is performed riserlessly.

13. The method of claim 1, further comprising:

retrieving the PCA and the upper cementing tool;

setting a bridge plug in the inner casing bore; and forming a cement plug on the set bridge plug.

14. A method of sealing an annulus of a subsea well present between an inner tubular and an outer tubular of the well, comprising;

deploying a lower cementing tool through open sea to a subsea wellhead;

fastening a pressure control assembly (PCA) to the subsea wellhead after deploying the lower cementing tool;

setting a packer of the lower cementing tool against a bore of a tubular of the well;

hanging an upper cementing tool from the PCA and stabbing the upper cementing tool into a polished bore receptacle of the lower cementing tool;

perforating a wall of the inner tubular to create at least one perforation;

mixing a resin and a hardener to form a sealant;

providing a cement slurry;

pumping a fluid train through the at least one perforation in the tubular, where the fluid train comprises the sealant followed by the cement slurry; and providing a volume of a non-setting liquid between the sealant and the cement slurry.

15. The method of claim 14, further comprising:

perforating the wall of the inner tubular and a wall of the outer tubular below the packer;

perforating the walls of the inner and outer tubular above the packer;

pumping a second fluid train through bores of the upper and lower cementing tools and into an outer annulus formed between the outer tubular and a third tubular, wherein the fluid train comprises the sealant followed by the cement slurry.

16. A method of sealing an annulus between an inner and an outer casing in a subsea wellbore, comprising:

inserting a lower cementing tool into a subsea wellhead;

fastening a pressure control assembly (PCA) to the subsea wellhead after inserting the lower cementing tool;

pumping a fluid train comprising, a cement slurry, a spacer fluid, and a sealant through perforations in an inner tubular, the perforations in communication with an annulus around the inner tubular, the sealant comprising:

bisphenol F epoxide, a hardener selected from a group consisting of tetraethylenepentamine for a low temperature well and diethyltoluenediamine for a high temperature well, and a diluent selected from a group consisting of alkyl glycidyl ether and benzyl alcohol mixed with the bisphenol F epoxide prior to mixing the bisphenol F epoxide with the hardener.

17. The method of claim 16, wherein the spacer fluid comprises a non-setting liquid.

* * * * *